US008033928B2

(12) United States Patent
Cage

(10) Patent No.: US 8,033,928 B2
(45) Date of Patent: Oct. 11, 2011

(54) METHOD AND APPARATUS FOR AN ASSISTIVE ENERGY TYPE GOLF CLUB

(76) Inventor: Donald R. Cage, Longmont, CO (US)

( * ) Notice: Subject to any disclaimer, the term of this patent is extended or adjusted under 35 U.S.C. 154(b) by 644 days.

(21) Appl. No.: 12/175,306

(22) Filed: Jul. 17, 2008

(65) Prior Publication Data

US 2008/0280692 A1 Nov. 13, 2008

Related U.S. Application Data

(63) Continuation-in-part of application No. 11/530,163, filed on Sep. 8, 2006, now Pat. No. 7,731,602.

(60) Provisional application No. 60/717,170, filed on Sep. 15, 2005.

(51) Int. Cl.
*A63B 53/00* (2006.01)

(52) U.S. Cl. ..... 473/324; 473/221; 473/222; 473/223; 473/224; 473/234; 434/1; 434/2; 434/3; 434/4; 434/252; 463/3

(58) Field of Classification Search ..... 473/221–224, 473/234, 324, 333; 434/1–10, 252; 463/3, 463/5

See application file for complete search history.

(56) References Cited

U.S. PATENT DOCUMENTS

| | | | | |
|---|---|---|---|---|
| 769,939 | A * | 9/1904 | Clark | 473/329 |
| 4,170,357 | A | 10/1979 | Greer | |
| 5,082,276 | A * | 1/1992 | Stevens | 473/223 |
| 5,522,594 | A * | 6/1996 | Taylor et al. | 473/131 |
| 5,709,610 | A * | 1/1998 | Ognjanovic | 473/223 |
| 5,779,555 | A * | 7/1998 | Nomura et al. | 473/223 |
| 5,816,927 | A * | 10/1998 | Taylor | 473/131 |
| 6,139,440 | A | 10/2000 | Taylor | |
| 6,441,745 | B1 * | 8/2002 | Gates | 340/669 |
| 6,749,528 | B2 | 6/2004 | Wergart | |
| 6,872,148 | B2 * | 3/2005 | Lee | 473/131 |
| 2002/0171415 | A1 * | 11/2002 | Lim | 324/176 |
| 2005/0037862 | A1 * | 2/2005 | Hagood et al. | 473/345 |
| 2005/0076161 | A1 * | 4/2005 | Albanna et al. | 710/15 |
| 2005/0215340 | A1 * | 9/2005 | Stites et al. | 473/233 |
| 2006/0025229 | A1 * | 2/2006 | Mahajan et al. | 473/131 |

* cited by examiner

*Primary Examiner* — David L Lewis
*Assistant Examiner* — Chase Leichliter
(74) *Attorney, Agent, or Firm* — Duft Bornsen & Fishman LLP

(57) ABSTRACT

The present invention relates to method and apparatus adapted for use with an assistive energy type golf club which is safe to use, inconspicuous, and able to release sufficient assistive energy at the optimum time during a golf swing to add prescribed incremental velocity to a golf ball.

31 Claims, 29 Drawing Sheets

METHOD AND APPARATUS FOR AN ASSISTIVE ENERGY TYPE GOLF CLUB

CROSS REFERENCE TO RELATED APPLICATIONS

This nonprovisional application is a continuation-in-part application of nonprovisional application Ser. No. 11/530,163 filed Sep. 8, 2006 now U.S. Pat. No. 7,731,602 which claims priority to U.S. provisional application 60/717,170 filed Sep. 15, 2005, which is incorporated herein by reference.

FIELD OF THE INVENTION

The present invention relates to method and apparatus for an assistive energy type golf club that is safe to use, inconspicuous, and able to release sufficient assistive energy at the optimum time during a golf swing to add incremental velocity to a golf ball.

PROBLEM

Methods and apparatus are known for applying assistive energy to add incremental velocity to a golf ball. One purpose of these devices is to assist a golfer that is unable to execute a full golf swing due to physical impairment.

A golf club using assistive energy in the form of a compressed spring is shown in U.S. Pat. No. 769,939 to Clark, whose golf club is swung in a normal manner. When the golf club face strikes the ball, spring energy is released adding its energy to the acceleration of the golf ball.

A shoulder fired golf ball launching device is described in U.S. Pat. No. 6,749,528 to Wengert where assistive energy is provided by compressed gas. Upon firing the device, the compressed gas is released and propels the golf ball toward its target.

U.S. Pat. No. 4,170,357 to Greer describes a golf club head where the assistive energy is an explosive charge. The golf club is swung in a normal manner. When the golf club face strikes the ball, the impact triggers a firing pin to detonate the explosive charge which then adds its energy to the acceleration of the golf ball.

U.S. Pat. No. 5,522,594 to Taylor et al describes an invention whereby a golf club using an explosive charge for assistive energy, is placed against a golf ball, and by pressing buttons on the handle, the explosive charge detonates and drives a piston to impact the ball.

All the above inventions fail to meet the following criteria needed for a practical and effective assistive energy golf club.

1. To add sufficient assistive energy to achieve a normal drive golf shot.
2. To be safe and convenient for use in a normal golf setting.
3. To be inconspicuous and closely simulate the operation and effectiveness of a normal golf club.

The coil spring design of U.S. Pat. No. 769,939 to Clark is problematic because it is not able to store and release the requisite 100 foot pounds of energy needed for a normal drive golf shot. In Clark, energy is stored by compressing spring "c" by pulling finger piece "e" by hand as shown in his FIGS. 2 and 3 and described on page 1, lines 75 through 81 of his patent. By today's standards, the United States Department of Labor Occupational Safety and Health Administration ("OSHA") limits the maximum lifting or pulling force for a healthy adult to 50 pounds. Therefore, to comply with today's OSHA regulations the spring "c" of FIGS. 2 and 3 would be compressed by pulling finger piece "e" with a maximum force of 50 pounds. If a golfer could exert a force of fifty pounds by hand and compress the spring its entire length of a few inches, the total energy stored would only be about 12 foot pounds, this is nowhere near the required 100 foot pounds as explained hereinafter.

The shoulder fired golf ball launcher of U.S. Pat. No. 6,749,528 is highly conspicuous and does not simulate the operation and effectiveness of a normal golf club since it is not a golf club but more like a gun.

The explosive charge device shown in U.S. Pat. No. 4,170,357 is problematic from a noise, safety and convenience standpoint. Golf courses are traditionally quiet peaceful places where golfers enjoy playing golf outdoors in a peaceful setting. The introduction of noise from the firing of explosive cartridges would be intolerable. In addition, the carrying and handling and using of explosive cartridges creates safety and convenience issues. Since the terrorist attacks on the World Trade Center on Sep. 11, 2001, traveling with explosives has been prohibited on airplanes and other forms of public transportation, making traveling with this equipment difficult and often illegal.

The compressed gas design of U.S. Pat. No. 6,749,528 is problematic from the standpoints of noise, convenience, and safety, also purchasing, carrying and handling a compressed gas source necessary to supply the device. While compressed gas is available at welding shops and some sporting goods stores, it is not convenient or commonly available. In addition, compressed gas containers are not allowed on airplanes and many other forms of public transportation due to Federal safety regulations. This makes traveling with this equipment to play golf difficult and often illegal.

SOLUTION

The present invention solves the aforementioned problems by combining three elements. First, a safe power source such as a 25 battery or a connection to a vehicular or stationary electrical power supply is needed. Second, a velocity generating transducer is needed to convert stored energy from the power source into incremental golf ball velocity. Third, sensors and control electronics are required to sense the proximity of a golf club head relative to a golf ball, and determining if the golf club is being 30 properly and safely used. Based on golf ball proximity and safety parameters, the control electronics then gives a firing command to release assistive energy for the desired effect. These three elements in combination solve the above mentioned problems as next described.

1. Add Sufficient Assistive Energy for a Normal Drive Golf Shot.

The kinetic energy of a golf ball in a normal drive shot is approximately 62 foot-pounds after impact with the driver. This is calculated from a golf ball velocity of 200 feet per second and the weight of a normal golf ball of 0.1 pounds, using the energy equation 1.

$$E = \frac{1}{2} * \frac{W}{g} * V^2 \qquad \text{Eq. 1}$$

$$E = \frac{1}{2} * \frac{0.1}{32.2} * 200^2$$

$$E = 62 \text{ foot-pounds}$$

Where:

E=Kinetic energy of the driven golf ball.

W=Weight of a golf ball.

g=Acceleration of gravity.

V=Velocity of driven golf ball.

There are significant losses during the transfer of energy from an assistive energy golf club to a golf ball. For example, the impact efficiency, herein defined as the "Coefficient Of Restitution" ("COR"), between a normal golf ball and golf club is in the range of 60% to 80%. This means that when a golf ball is stuck with a golf club, the resulting velocity of the golf ball is only 60% to 80% of the theoretical maximum velocity possible if the impact were 100% efficient. The lost energy is converted to heat, vibration, spin, sound and other losses.

These energy losses require that the amount of assistive energy should be sufficient to add the desired incremental velocity to the golf ball, and to overcome all the losses. Therefore the required energy can be 100 foot pounds or more.

The present invention can easily store and release the required 100 foot pounds of energy. One preferred embodiment uses common batteries as the energy source. An electric motor to spin one or more flywheels, and linkage to convert flywheel spin into incremental golf ball velocity comprises the velocity generating transducer.

Another preferred embodiment uses common batteries as the energy source, and an electric motor to extend or compress a spring which temporarily stores and releases assistive energy for each golf shot as the velocity generating transducer.

Another preferred embodiment uses common batteries as the energy source. A capacitor is used to temporarily store electrical energy from the power source. A magnet and coil are used as the velocity generating transducer to convert electrical energy into assistive energy for each golf shot.

Another important aspect of the current invention is its ability to time control the release of assistive energy for the desired effect. The invention can be used without swinging the golf club which might be the case for some physically impaired golfers who can not swing the golf club. However, physically impaired golfers who can still swing a golf club generally prefer to use a golf club with some amount of swing to encompass the true spirit and essence of golfing. Therefore to use the golf club of the invention with swinging, proper timing control of the release of assistive energy is required for maximum effect.

For clarification of this requirement, a familiar analogy exists in the game of baseball. Here, a batter carefully watches the approach velocity of a pitched baseball and decides when to begin to swing the bat prior to the baseball reaching home plate. This decision is based on the approach velocity of the baseball, and on the batter's knowledge of how far he wants to hit the ball, and how long it takes to accelerate his bat up to the appropriate hitting speed prior to the arrival of the baseball.

During a normal golf shot, the golf ball is only in contact with the club face for a fraction of a millisecond. Since the release of assistive energy involves a sequence of electronic and mechanical events that can take a total of several milliseconds or more, the firing command must be anticipated and generated several milliseconds or more prior to the golf club head impacting the golf ball. Otherwise the golf ball will impact on the golf club face and travel some distance downrange before the striker can be accelerated to an effective hitting speed.

An embodiment of the current invention includes sensors which monitor the approach of the golf club head toward the golf ball, and electronics to decide when to give the firing command to release assistive energy to the golf ball. By controlling the amount of assistive energy available, and by proper timing of the firing command, the distance of the golf shot can be accurately controlled.

2. Safe and Convenient to Use in a Normal Golf Setting.

As earlier described, at least 100 foot pounds of energy are required for a full powered drive type golf shot. An 18-hole golf game normally requires two such full powered golf shots per hole, or 36 total full power shots. Therefore a complete golf game requires about 3600 foot pounds of energy delivered from an assistive energy golf club. A common AA sized alkaline battery holds over 9000 foot pounds of energy, easily enough for an entire golf game. These batteries are commonly available, safe and convenient and are not restricted by airlines or other forms of public transportation. The present invention can use batteries, or any convenient connection to a vehicular or stationary power source such as may be available on a golf cart, or a standard power outlet. While an electrical energy power source is preferred, any type of power source can be used with the present invention as long as it is safe and convenient.

In one preferred embodiment, one or more flywheels are caused to spin by an electric motor receiving energy from common batteries in the handle of the club. In another preferred embodiment, a spring is compressed by an electric motor which receives electrical energy from the common batteries in the handle of the golf club. In another preferred embodiment a magnet and coil are used which are activated by electrical current from a capacitor. The capacitor is charged by receiving electrical energy from any convenient and safe power source such as an auxiliary battery pack or a plug into an auxiliary power source.

In addition to the energy source being safe and convenient, the club itself must be safe to use. Golf clubs are often misused by striking them against a golfers shoe to dislodge dirt, or by children using them without adult supervision. It is, therefore, extremely important to provide safety features to eliminate the possibility of accidental firing of the golf club. In one preferred embodiment, sensors and control electronics are used to prevent accidental firing of the golf club and to assure that the golf club is being used properly before enabling the assistive energy release. Sensors are used to assure proper proximity of a golf ball, and that the golf club is oriented correctly for a normal golfing stance prior to and during a swing. The sensors and control electronics determine that a proper back swing and forward swing are executed prior to enabling the assistive energy release for the golf shot. If the golf club is being used in a swingless manner, sensors are used to assure proper proximity of a golf ball, and that the golf club is oriented correctly for a normal golfing stance. Control electronics then gives the firing command when the golfer presses a switch for that purpose.

In addition, the control electronics can be programmed to prevent misuse by a golfer who may try to use the invention to drive a golf ball farther than is normally possible thereby endangering people downrange. By limiting the available assistive energy, and proper timing of the firing command, the release of assistive energy can add greater or lesser amounts of incremental velocity to a golf ball as the situation demands. Sensors and control electronics determine the golf club head velocity as the golf club head approaches the golf ball during a golf swing. If the golf club head velocity is too high, the release of assistive energy is disabled or minimized through timing control of the firing command to prevent the golf ball from exceeding a predetermined maximum velocity. Additional safety features are further explained hereinafter.

3. To be Inconspicuous and Closely Simulate the Operation and Effectiveness of a Normal Golf Club.

Golf is steeped in tradition and etiquette covering all aspects of the game. Many golf courses have strict rules restricting dress code, loud or inappropriate language, playing too slowly, hitting balls too close to the people in the preceding golf group, and many others. To adhere to golf course rules and etiquette, an assistive energy golf club must be inconspicuous and closely simulate the operation and effectiveness of a normal golf club.

In one preferred embodiment, the golfer selects the desired distance for the golf shot using a small switch on the grip of the club, then addresses the golf ball in a normal manner and stance. After pressing a small switch on the grip to activate the club, the golfer swings the golf club in a normal manner. During the swing, the golf club electronically determines when to give the firing command to release its assistive energy for the desired effect. During the swing, the assistive energy is released and the golf ball is driven downrange the specified distance in a manner that looks and sounds like a normal golf shot. Since the golf ball travels a specified distance, the problems of playing too slowly, or hitting balls too closely to people in the preceding golf group are eliminated.

Since the entire golf swing process looks and sounds normal, the present invention is inconspicuous and closely simulates the operation and effectiveness of a normal golf club.

DESCRIPTION OF THE DRAWINGS

FIG. 15 shows the cross section of the trigger components in their cocked positions ready to fire.

FIG. 16 shows the cross section of the trigger components just after the firing command has been given and the assistive energy is being released.

DETAILED DESCRIPTION OF THE INVENTION

Figure 1:
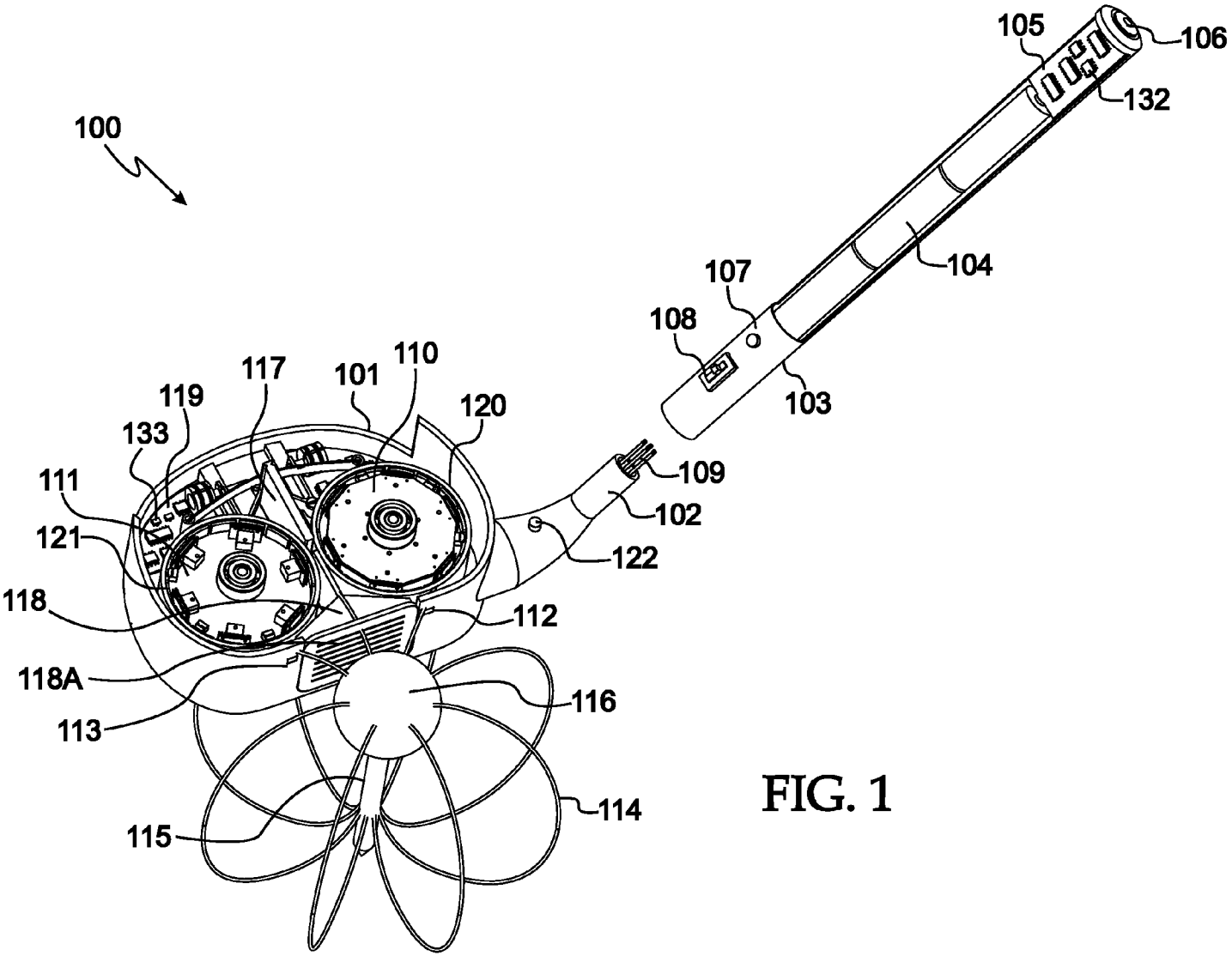
FIG. 1 is an isometric view of the major components of one preferred embodiment of the present invention where the velocity generating transducer is an electric motor that spins flywheels to store and release the assistive energy for each golf shot. The top cover of golf club head 101, most of the length of shaft 102, and a section of grip 103 have been removed for visual clarity of the components contained therein. The embodiment is shown in position in front of a golf ball 116 as it would normally be used.

FIGS. 1-29 and the following description depict specific exemplary embodiments of the invention to teach those skilled in the art how to make and use the invention. For the purpose of teaching inventive principles, some conventional aspects of the invention have been simplified or omitted. Those skilled in the art will appreciate variations from these embodiments that fall within the scope of the invention. Those skilled in the art will appreciate that the features described below can be combined in various ways to form multiple variations of the invention. As a result, the invention is not limited to the specific embodiments described below, but only by the claims and their equivalents.

The physical design of one exemplary embodiment of the present invention is next described with reference to the drawings. FIG. 1 through 9 are various views of one preferred embodiment of the present invention where the assistive energy for each golf shot is supplied in the form of electrical energy by batteries 104 then converted into the mechanical energy of spinning flywheels. The major components of golf club 100 include golf club head 101, shaft 102, and grip 103.

Grip 103 includes one or more batteries 104 which store energy for one or more golf shots. It was earlier stated that one AA size alkaline battery holds enough energy for an entire golf game. However, multiple batteries 104 are here connected together in various ways, to provide voltage and current supply compatible with control electronics 105, and 119, and flywheel motor assemblies 110 and 111. Control electronics 105 provides control functions including battery 104 monitoring and recharging, golf club 100 orientation and motion sensing using accelerometers 132, support for activation switch 107, and range selection switch 108, program and algorithm communication, storage and execution, and other functions. Electrical contact 106 provides electrical connection between golf club 100 and auxiliary power and communications when golf club 100 is placed into an associated recharging and storage receptacle tube as further explained hereinafter.

Club head 101 is connected to grip 103 by shaft 102 which includes wires 109 for the conveyance of electrical signals between grip 103 and golf club head 101. Golf club head 101 includes flywheel motor assemblies 110 and 111 which further include flywheels 120 and 121 which store and deliver assistive energy for each golf shot in the form of spinning flywheel inertia. Two flywheel motor assemblies 110 and 111 are preferred although any number could be used. Flywheel motor assemblies 110 and 111 are designed to be quiet, fit easily inside of a golf club head, and to store and release the energy needed for each golf shot. Flywheel motor assemblies 110 and 111 convert electrical energy from batteries 104 into mechanical energy in the form of spinning flywheel inertia.

Flywheel motor assemblies 110 and 111 are symmetrical and flywheels 120 and 121 spin in opposite directions to counteract any gyroscopic forces that would otherwise be felt when using golf club 100. Flywheel motor assemblies 110 and 111 are designed to be three phase brushless DC motors whose rotors are flywheels 120 and 121, which are caused to spin by control electronics 119 at a predetermined spin rate. Commercially available motors could be used to drive flywheels 120 and 121, however, building combined motor and flywheel assemblies conserves space and weight. Any type of motor can be used to cause flywheels 120 and 121 to spin including non-electrical and manually driven motors, however electric motors are preferred.

Figure 2:
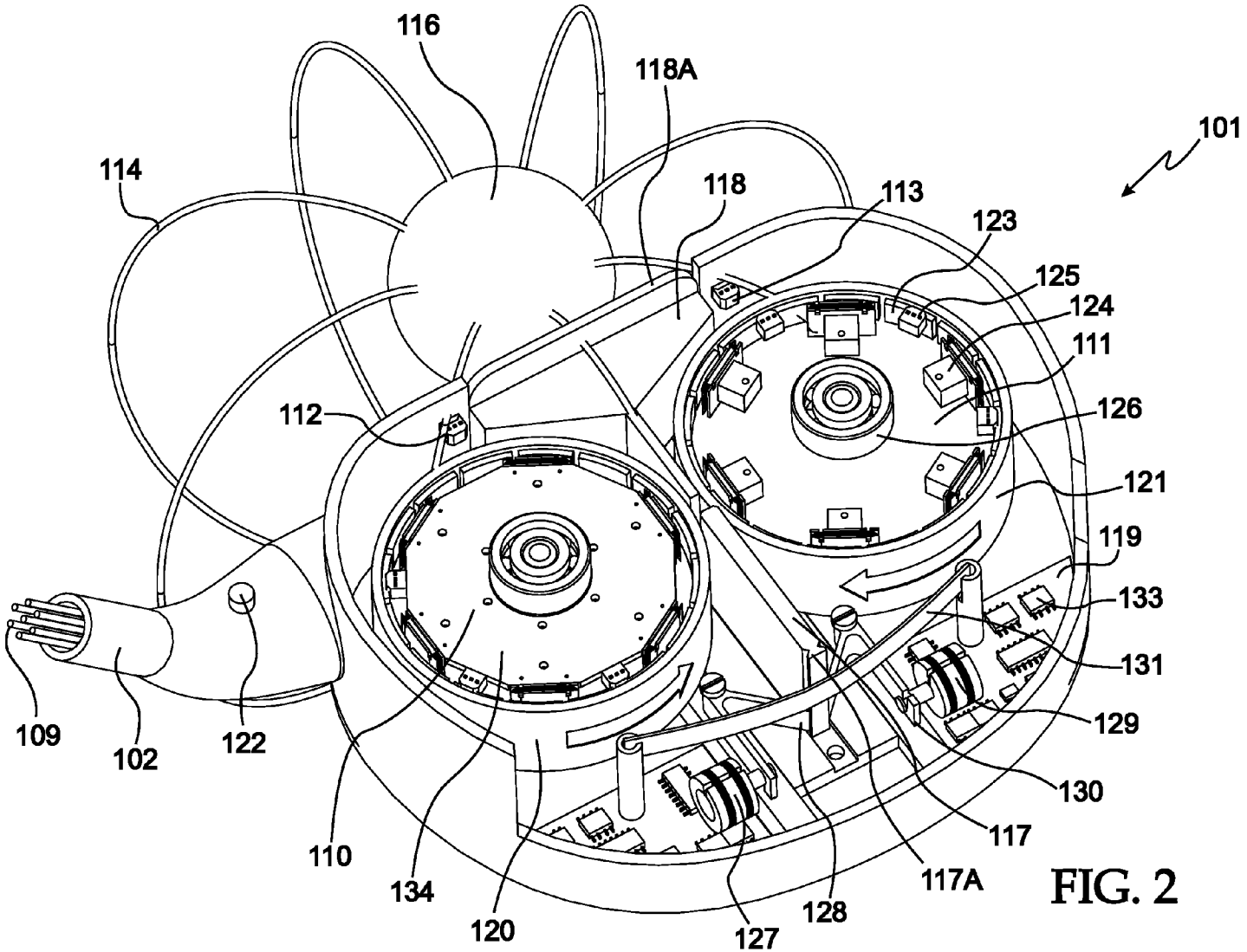
FIG. 2 shows club head 101 of FIG. 1 with the internal components in their cocked positions ready to fire.

The major elements of flywheel motor assembly 111 are shown in detail in FIG. 2. Flywheel motor assembly 111 includes flywheel 121, drive magnets 123 mounted to flywheel 121, drive coils 124 mounted to pc board like 134 but not shown in this view, rotor position hall sensors 125 also mounted to pc board like 134 but not shown in this view, and bearings 126. Brushless DC motors are well known in the art and need no further explanation here except that rotor flywheels 120 and 121 are designed to have a spinning moment of inertia of about 0.00062 inch-pound-seconds-squared, and to freely and quietly spin at 30,000 revolutions per minute "RPM". The amount of assistive energy stored by flywheels 120 and 121 would then be 255 foot pounds each. The total available energy from both flywheels 120 and 121 would be (2*255) or 510 foot pounds when spinning at 30,000 RPM. This is far more than the aforementioned 100 foots pounds required for a golf shot. In practice, flywheels 120 and 121 are designed to retain a percentage of their original spin rate after each golf shot so only a portion of the available 510 foot pounds of energy is used for each golf shot. The spin rate of flywheels 120 and 121 is stopped or reversed for re-cocking purposes after each golf shot and prior to the next golf shot as is later explained.

Club head 101 further includes proximity sensors 112 and 113 which are hall effect sensors positioned to sense magnetic field 114 emanating from golf tee 115. Golf tee 115 is made of or contains a magnet or magnetic field producing material such as Neodymium Iron Cobalt, or a battery and coil, for the creation of magnetic field 114. As a practical matter, magnetic field 114 could be made to emanate from a specially made golf ball (not shown) instead of from a tee 115, however it is advantageous to use a normal golf ball 116. Golf ball 116 is perched atop tee 115 in a normal manner so that proximity sensors 112 and 113 can thereby determine the proximity of golf ball 116 by sensing the strength and orientation of magnetic field 114. The proximity of golf ball 116 is used to determine if and when to give the firing command to release assistive energy as further explained hereinafter.

Figure 11:
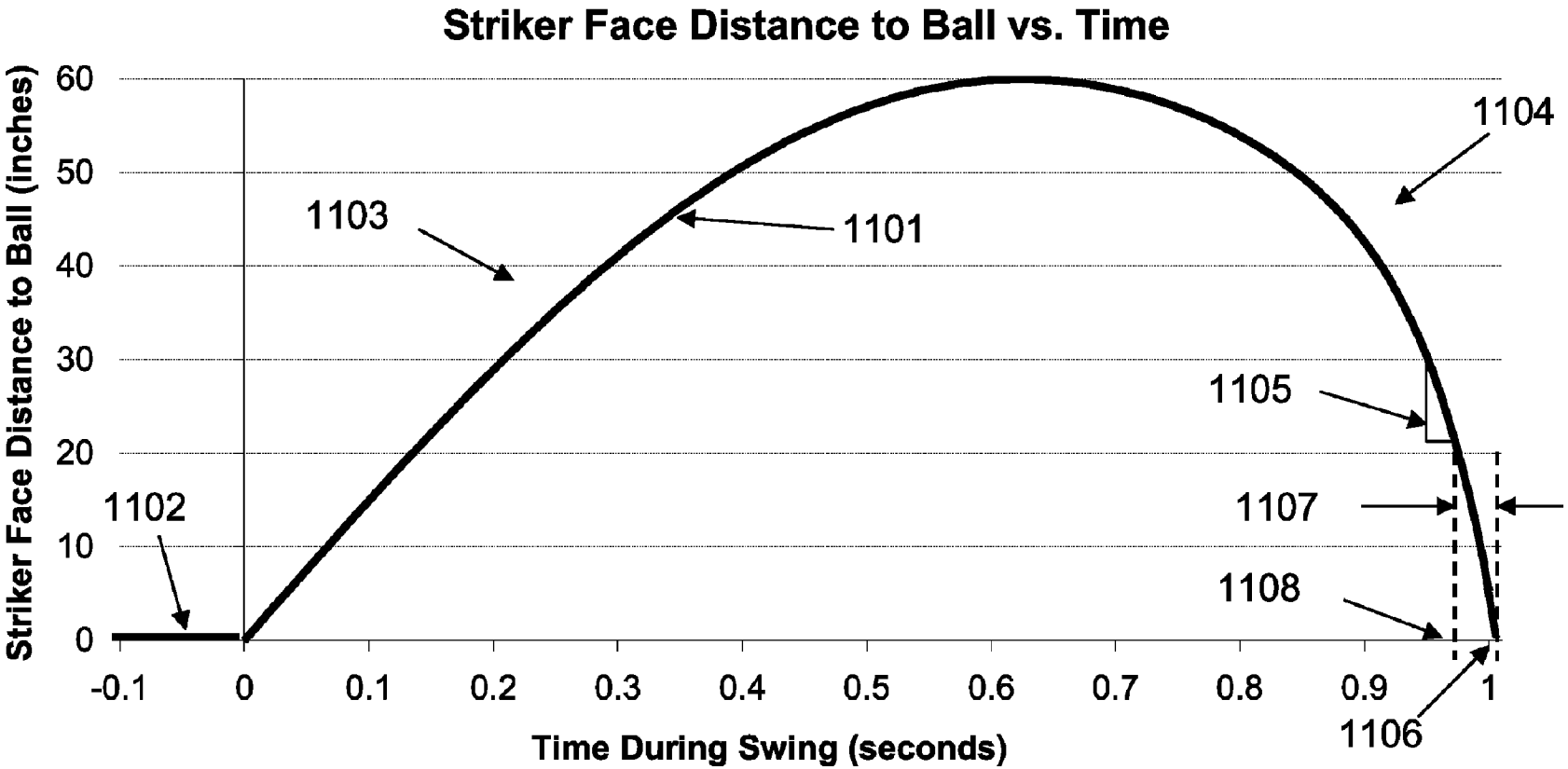
FIG. 11 is a graph showing distance between the striker face and the golf ball vs. time that would be sensed by proximity sensors on the golf club head of FIGS. 1 and 13 during a normal golf swing.

FIG. 11 shows curve 1101 representing the proximity of golf ball 116 to striker face 118A as a function of time during a normal golf swing. Area 1102 shows the initial zero distance value where the golfer addresses ball 116 and places striker face 118A behind and just touching golf ball 116. Area 1103 shows the backswing, and area 1104 shows the fore swing. From this curve 1101, the approach velocity of club head 101 toward golf ball 116 can be determined from the slope 1105 of curve 1101 using signal differentiation or slope calculation methods that are well known. The time at impact 1106 can then be predicted where curve 1101 intersects its initial zero distance value 1102 by using linear or non-linear extrapolation methods that are well known. Curve 1101 is used to calculate the time to give the firing command 1108 which is normally prior to golf ball impact 1106 by a pre trigger time 1107 that is calculated as hereinafter explained.

Many types of sensors and transmitters can be used for this golf ball proximity sensing purpose including ultrasonic type, laser type, radar type, accelerometer type, metal detector type, magnetic type, contact type, light emitting diode type, and others. For example sensor 113 can be an ultrasonic receiver used in conjunction with an ultrasonic transmitter 112. As another example sensor 113 can be a laser type receiver used in conjunction with a laser type transmitter 112. As another example sensor 113 can be a metal detector type receiver used in conjunction with a metal detector type signal transmitter 112, and ball 116 would be a common golf ball having a metal core. The details of the proximity sensor may vary so long that it, along with control electronics 119, can determine when to give the firing command to release assistive energy for the desired effect. Normally the time to give the firing command is a number of milliseconds prior to golf ball impact because of inherent delay characteristics of a specific golf club design. Inherent delays in the embodiment of FIG. 1 include the following steps which take place after the firing command is given and before impact with golf ball 116. The total time represented by these steps can be several milliseconds or more:

1. Turn-on time for a switch to apply current to trigger coils 127 and 129.
2. Ramping up the current in trigger coils 127 and 129.
3. Pulling triggers 128 and 130 out of grooves 117A.
4. Accelerating ram 117 toward engagement with flywheels 120 and 121.
5. Engaging ram 117 between flywheels 120 and 121.
6. Accelerating striker 118 forward toward golf ball 116.
7. Impacting golf ball 116 with striker face 118A.

Figure 12:
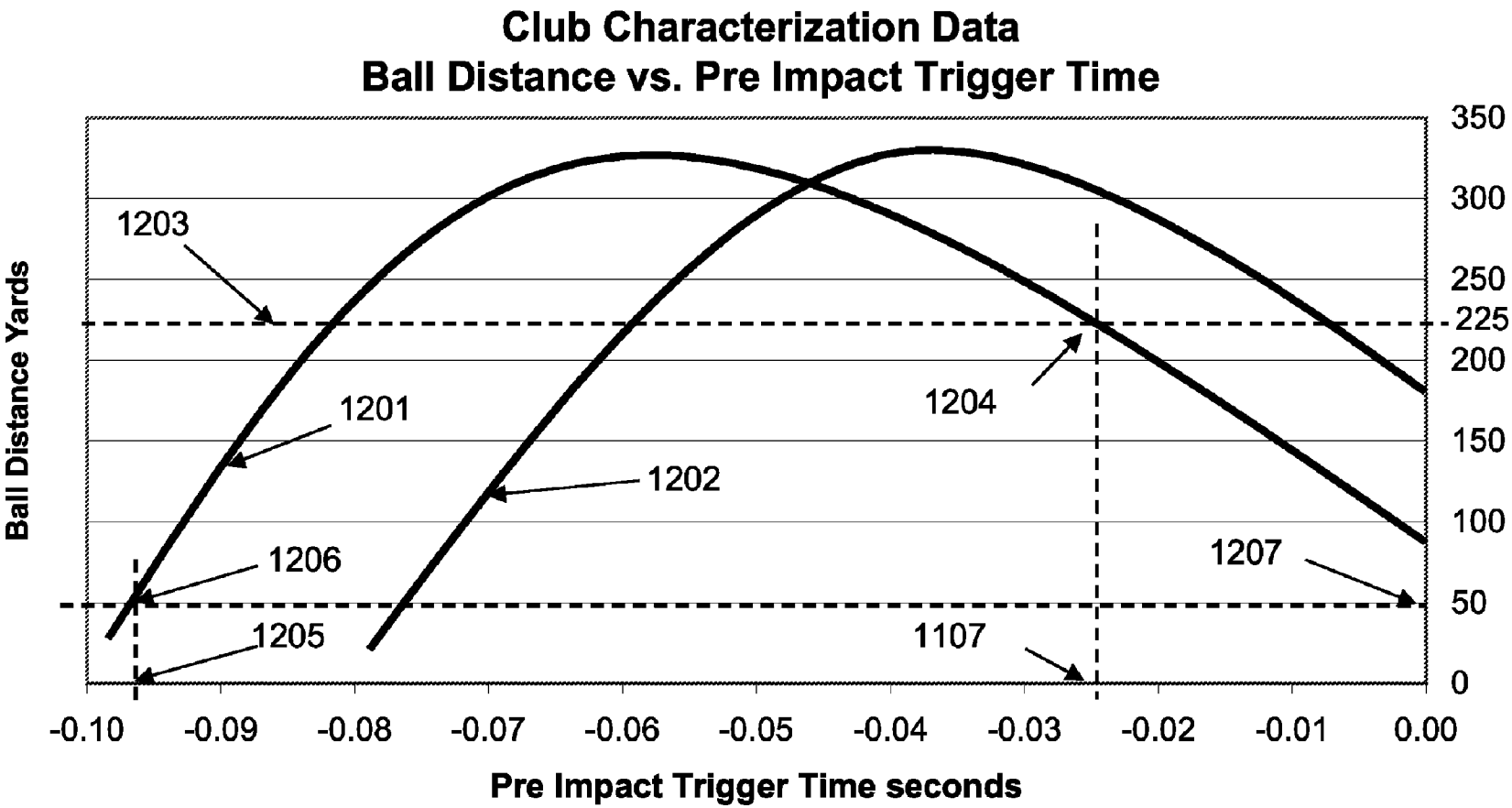
FIG. 12 is a graph showing characterization data of a golf club of the present invention. The graph shows resulting golf ball distance vs. pre impact trigger time for two different approach velocities. These data are pre-determined for a specific golf club design, and stored in control electronics for use in determining when to give the firing command. These data are used for the embodiments of FIGS. 1 and 13.

By testing a golf club design for resulting golf ball distance vs. pre impact triggering time at a specific approach velocity, a characterization curve 1201 is created and the information is stored in control circuit 119 for a determination of when to give the firing command. FIG. 12 is a graph of such a characterization curve 1201 of the present invention. FIG. 12 shows how the resulting golf ball distance varies as a function of when the firing command is given prior to golf ball impact. Curve 1201 is representative of a specific approach velocity and curve 1202 is representative of a different approach velocity. Curves 1201 and 1202 are made by testing club 100 under specific fairway and weather conditions, and results will vary for other conditions. Families of curves for different approach velocities are determined and the data stored in control electronics 119 for determination of when to give the firing command during each golf shot. By examination of curve 1201 in FIG. 12 the desired distance 1203 of 225 yards, intersects curve 1201 initially at point 1204 which relates to a pretrigger time 1107 of about −0.025 seconds. This means that the desired golf shot distance of 225 yards will be achieved if the firing command is given 0.025 seconds prior to impact time 1106. The firing command would then be given at point 1108 of curve 1101.

The exact shape of characterization curves such as curves 1201 and 1202 are completely dependant on the design of the golf club, and the approach velocity 1105, and specific fairway and weather conditions, and can vary widely from those shown in FIG. 12.

Normally the firing command is timed to add incremental velocity to a golf ball, however, the firing command can also be timed to minimize or subtract incremental velocity thereby achieving golf ball velocities and distances that are less than what would be achieved by using golf club 100 without releasing any assistive energy. The purpose of subtracting incremental velocity would be for safety reasons to limit golf shot distance, or for training or demonstration purposes. For example, by using a pre impact trigger time 1205 of about −0.097 seconds corresponding to point 1206 on curve 1201, a distance of 50 yards 1207 would be achieved which is less than what would be achieved if no firing command is given at all.

An alternative method of determining when to give a firing command is to use the proximity of golf ball 116 to striker face 118A directly. For example, curve 1101 can be used directly by control electronics 119 to give a firing command when striker face 118A has reached a prescribed distance from golf ball 116, without taking into account the response and delay characteristic curve 1201 of club 100. This alternative method is a simplification and can be used effectively when a golfer has a consistent approach velocity.

Figure 3:
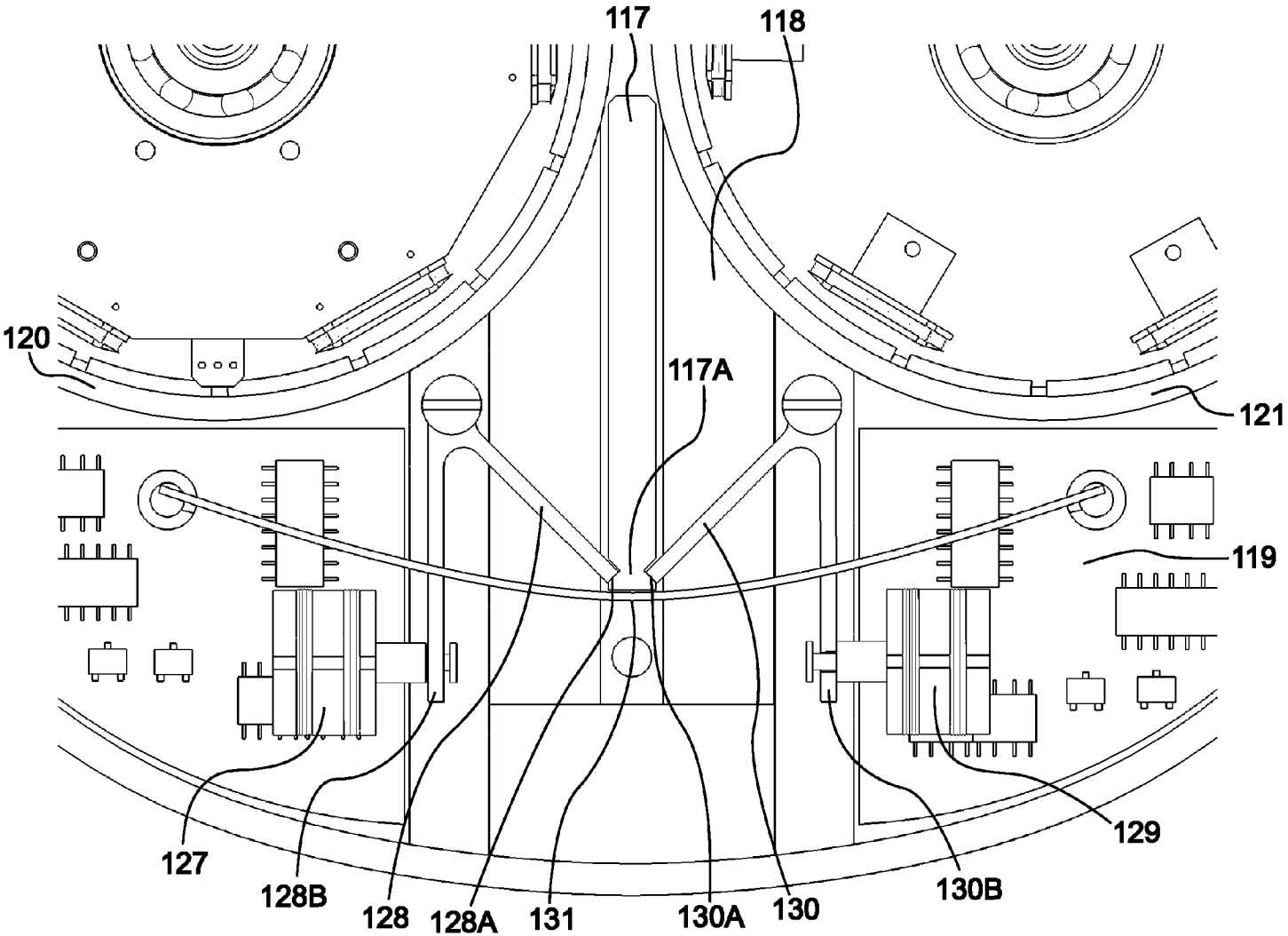
FIG. 3 shows a close up detailed view of the triggering mechanism of FIG. 2.

Prior to a firing command being given, the components within club head 101 are in a cocked position as shown in FIGS. 1, 2, and 3. Flywheels 120 and 121 are spinning at an appropriate speed, and sliding ram 117 is being held in a cocked position. In this cocked position, sliding ram 117 is being pushed from behind by spring 131 but is prevented from moving by triggers 128 and 130. Triggers 128 and 130 have sear ends 128A and 130A which are positioned in grooves 117A at the rear end of sliding ram 117 thereby preventing motion.

Figure 4:
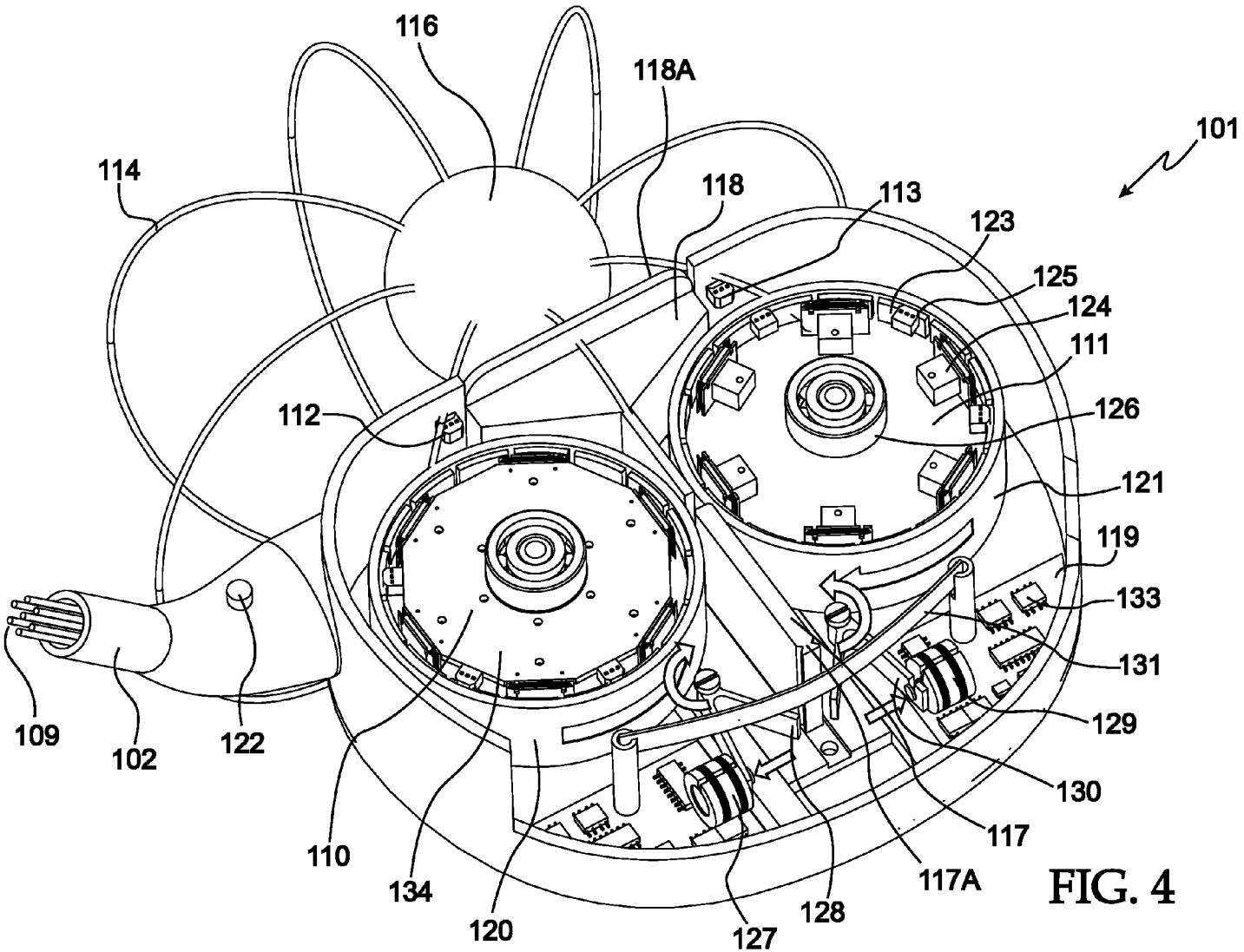
FIG. 4 shows club head 101 just after the firing command has been given and triggers 128 and 130 are being pulled from their grooves 117A.
Figure 5:
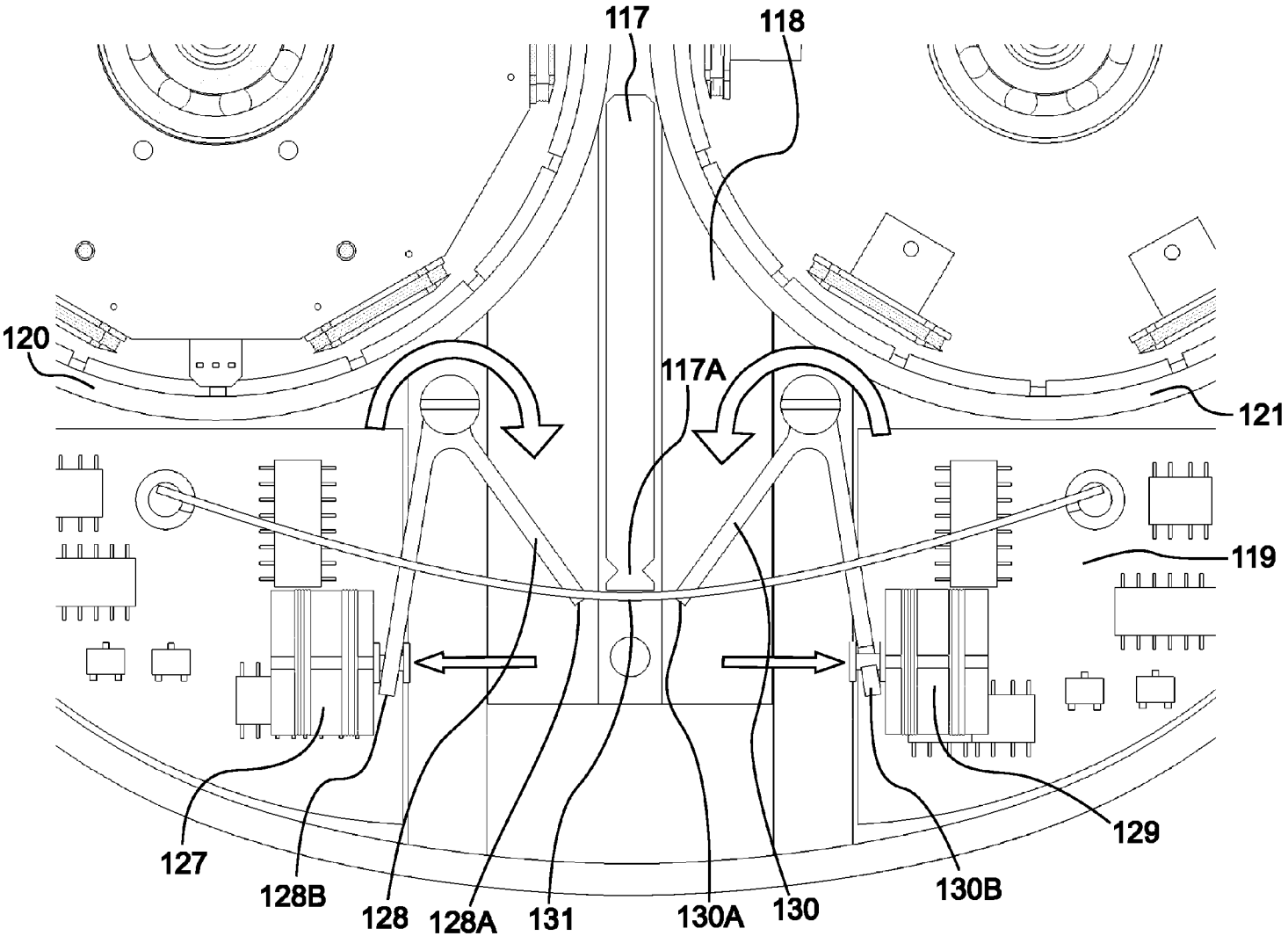
FIG. 5 shows a close up detailed view of the triggering mechanism of FIG. 4.

On FIGS. 4 and 5, when the firing command is given by control electronics 119, trigger coils 127 and 129 are activated to pull on the distall ends 128B and 130B of triggers 128 and 130. This pulls sear ends 128A and 130A out of grooves 117A.

Figure 6:
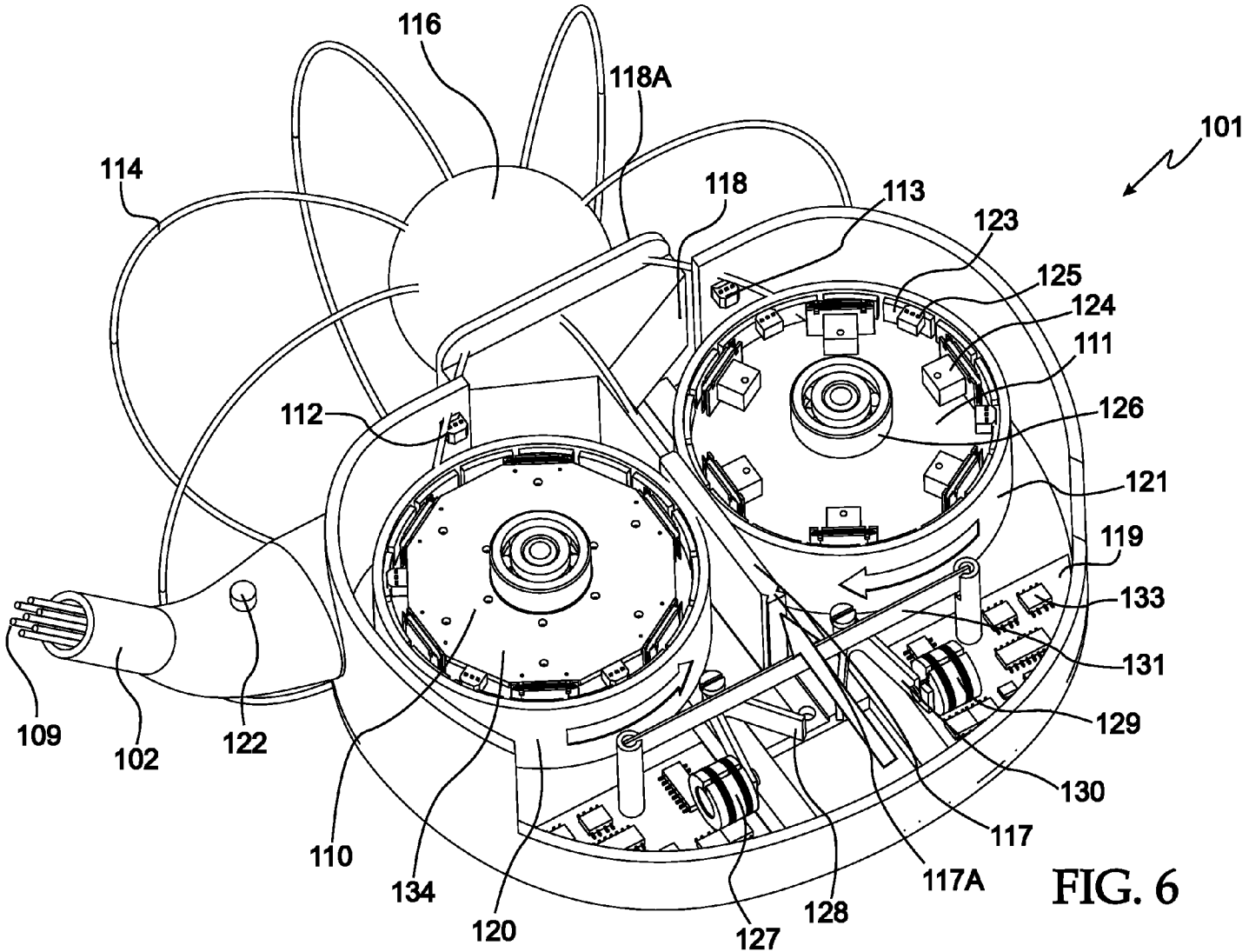
FIG. 6 shows club head 101 just after triggers 128 and 130 have been pulled from grooves 117A, and ram 117 is being accelerated forward by spring 131.
Figure 7:
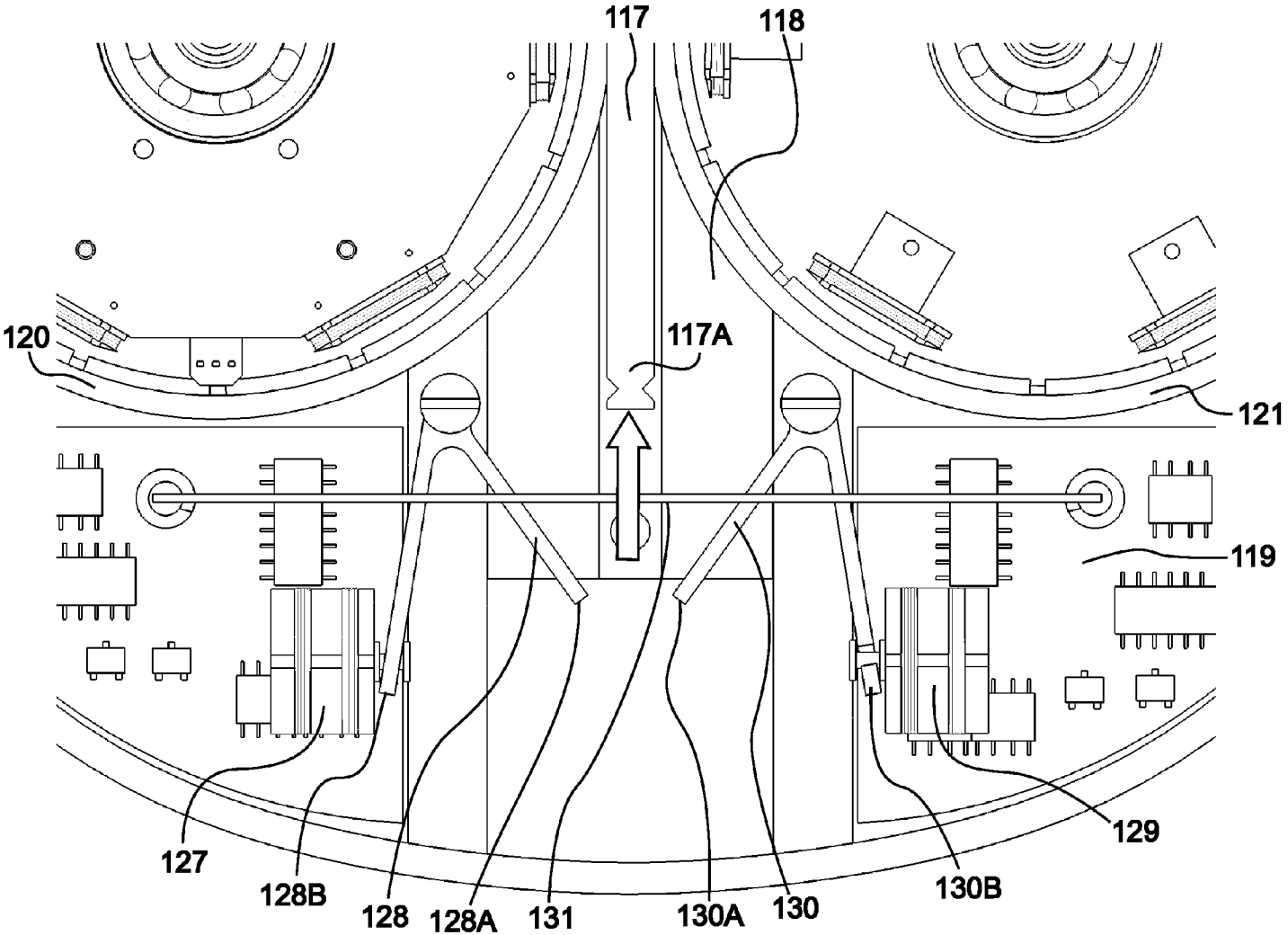
FIG. 7 shows a close up detailed view of the triggering mechanism of FIG. 6.

On FIGS. 6 and 7, with trigger sear ends 128A and 130A removed from grooves 117A, sliding ram 117 accelerates forward under the force of spring 131. Sliding ram 117 then engages flywheels 120 and 121 and is pinched there between by a gripping force due to the spinning action and the spacing of flywheels 120 and 121. The spacing between flywheels 120 and 121 is designed to be slightly less than the thickness of sliding ram 117 to create a strong gripping force. Sliding ram 117 is then thrust forward by spinning flywheels 120 and 121, which pushes striker 118 forward to impact golf ball 116 and transferring assistive energy from flywheels 120 and 121 into golf ball 116 at the appropriate time for the desired effect as shown in FIG. 6. Ram 117 and striker 118 together form a two piece linkage apparatus which converts the spinning energy of flywheels 120 and 121 into incremental velocity in golf ball 116. As a practical matter, ram 117 and striker 118 could be designed as a single piece linkage apparatus however a two piece linkage apparatus is faster to accelerate and has other design advantages.

Figure 8:
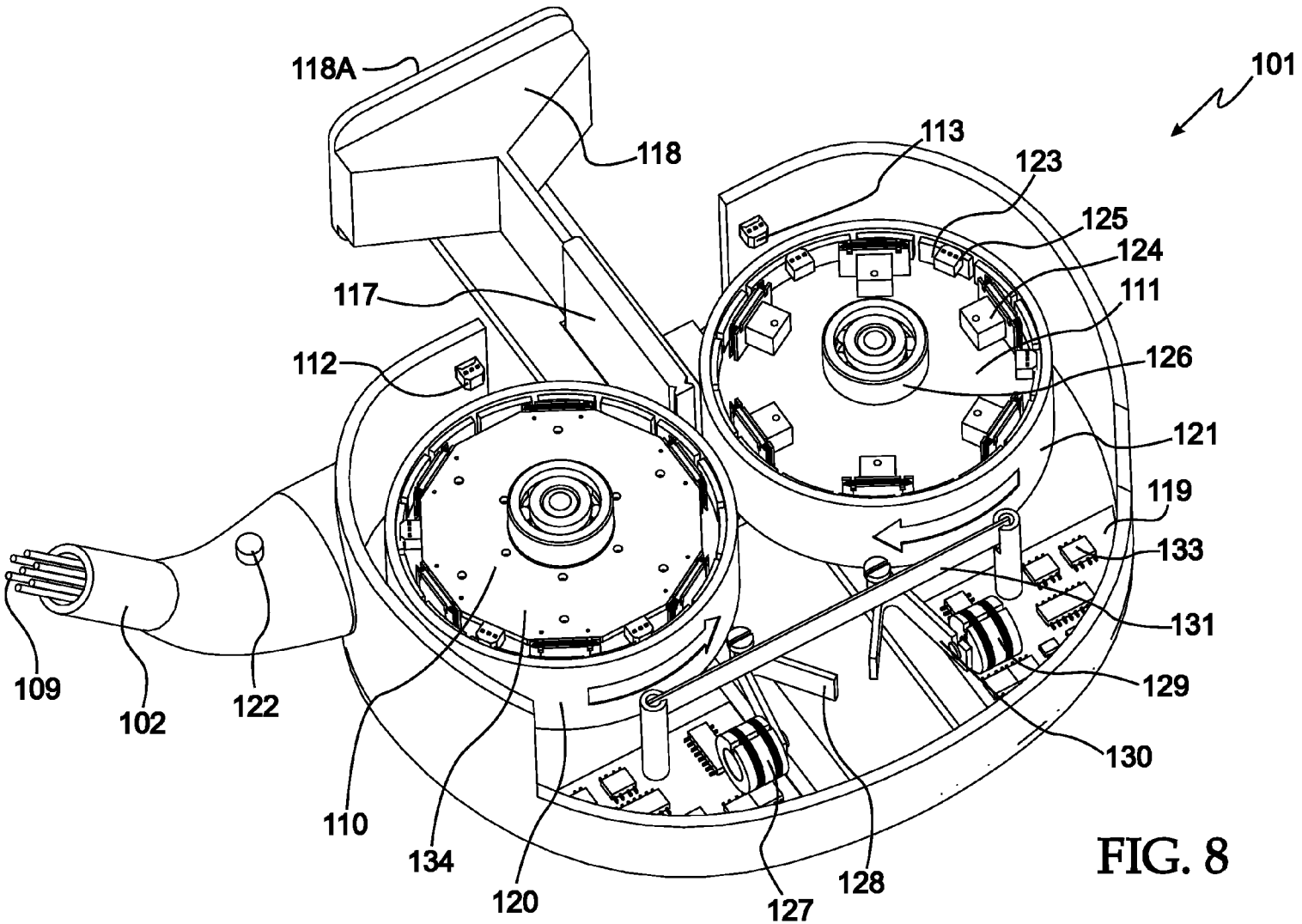
FIG. 8 shows the positions of components within club head 101 just after a golf shot has been completed.
Figure 9:
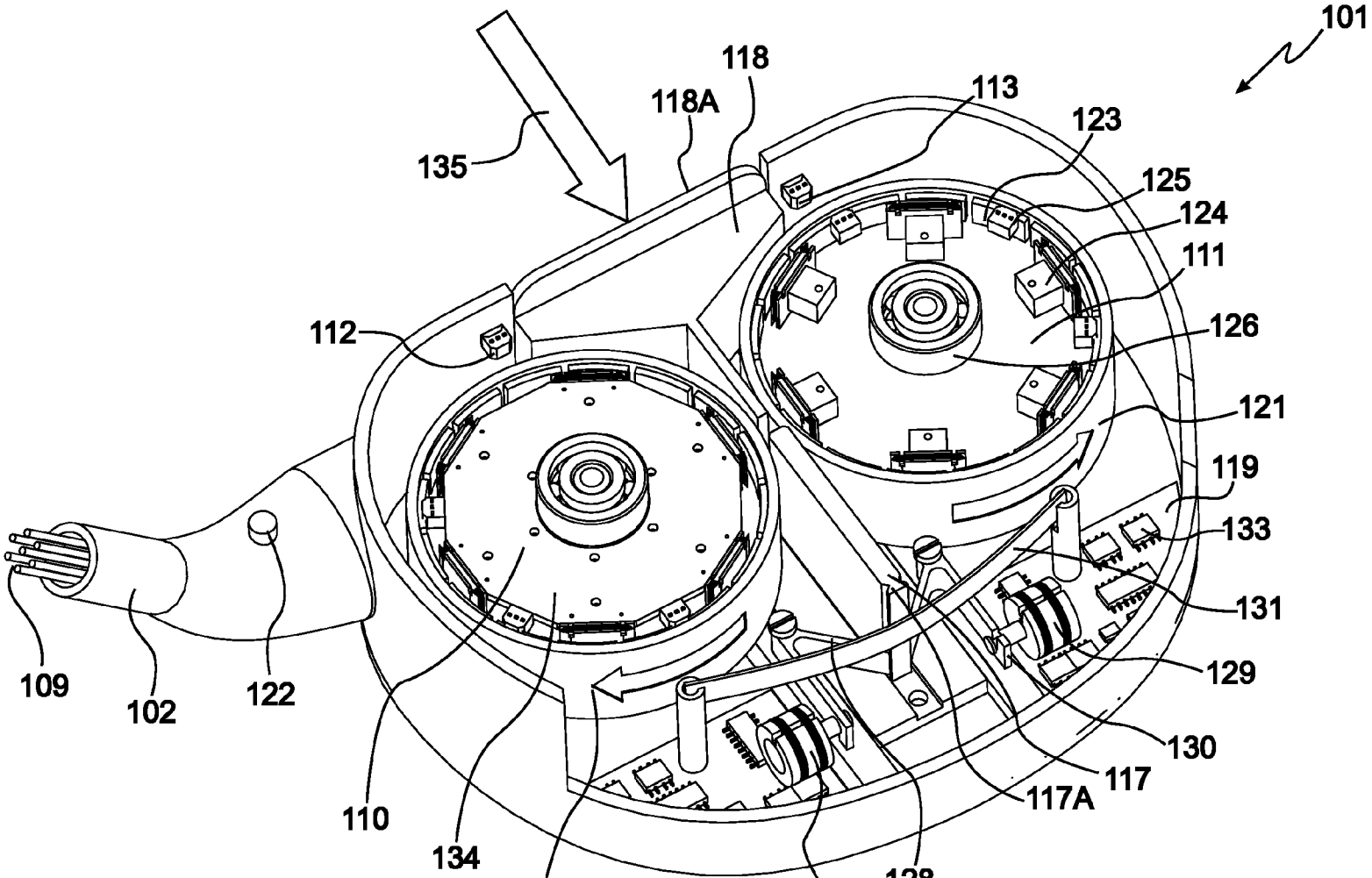
FIG. 9 shows the components within club head 101 being re-cocked for the next golf shot.

After the completion of the golf shot in FIG. 8, control electronics 119 stops the spinning of flywheels 120 and 121, and sliding ram 117 and striker 118 are pushed back into their initial cocked positions by hand with force 135 as shown in FIG. 9. Force 135 is the force required to engage sliding ram 117 between flywheels 120 and 121 and is a few pounds. Force 135 can be accomplished by a user pressing, or by tapping striker face 118A against a sold object.

An alternate method of returning sliding ram 117 and striker 118 to their original cocked positions is to run flywheels 120 and 121 in reverse direction to re-cock sliding ram 117 and striker 118 into their initial cocked positions in an automatic manner (non shown).

Figure 10:
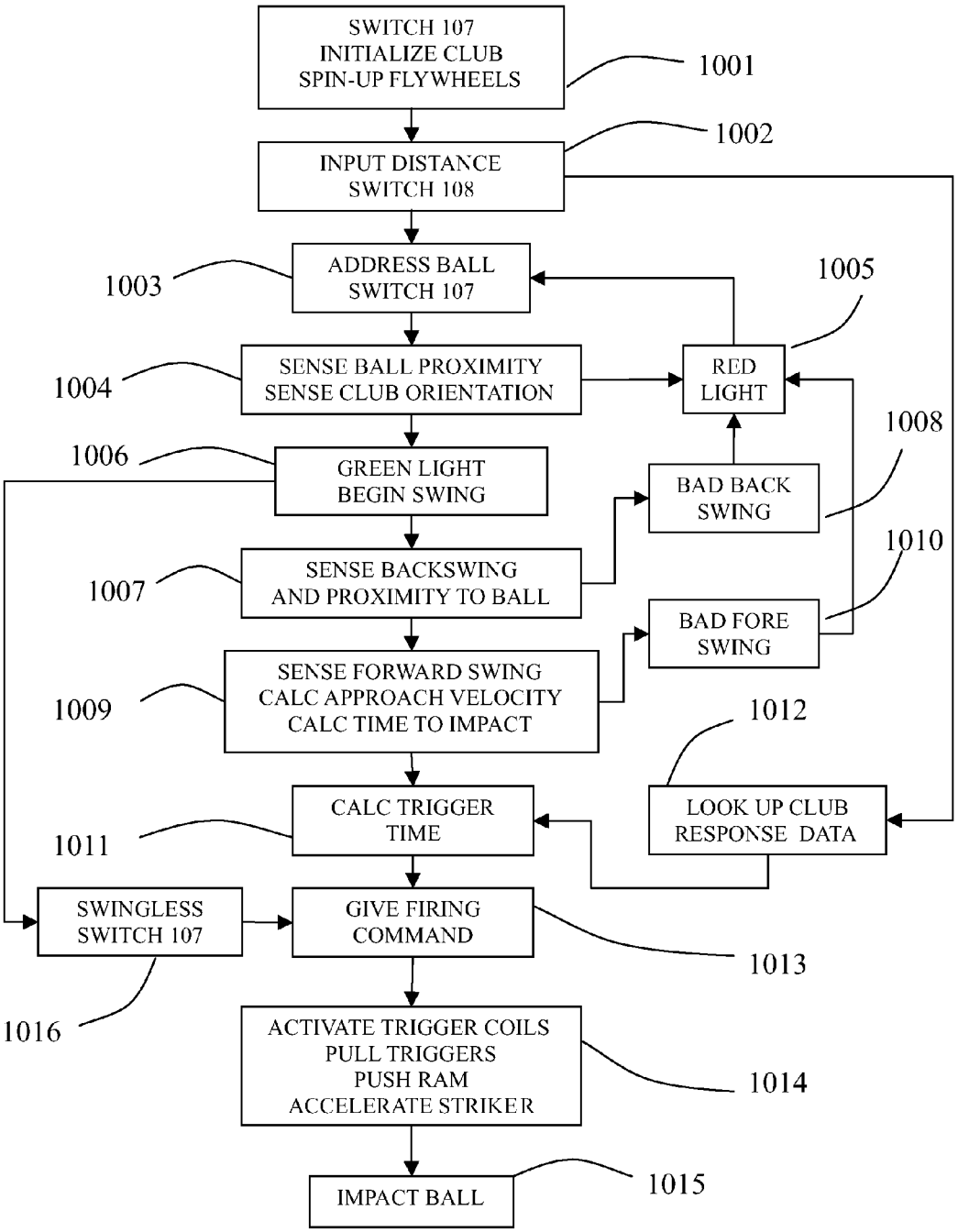
FIG. 10 is a flow chart outlining the steps for the use of the embodiment of FIG. 1.

FIG. 10 is a flow chart summarizing the sequence of events during the use of the embodiment of FIG. 1 as follows:

FIG. 10 Reference Description:

Step 1001 The golfer first presses switch 107 approximately 30 seconds or more prior to the golf shot. This initializes golf club 100 and begins spinning up flywheels 120 and 121 allowing time to reach a prescribed spin rate as next described. The golfer can use this time to place golf ball 116 on tee 115.

Step 1002 The golfer selects the desired golf shot distance for example 225 yards, using distance selection switch 108. This inputs a desired distance value that will be used later during the calculation of the trigger time when the firing command is given. If golf club 100 has been programmed to be used in a swinging manner, flywheels 120 and 121 are accelerated to a spin rate adequate for the selected distance 1203 of FIG. 12, for example 30,000 RPM. If golf club 100 has been programmed to be used in a swingless manner, flywheels 120 and 121 are accelerated to a spin rate determined by curve 2701 of FIG. 27, and the desired golf shot distance 2702, which occurs at point 2703 and indicates a spin rate 2704 of 22,500 RPM of FIG. 27.

Step 1003 The golfer addresses the golf ball in a normal manner by placing striker face 118A of striker 118 directly behind and just touching golf ball 116, and presses switch 107 to sense the proximity of golf ball 116.

Step 1004 Proximity sensors 112 and 113 sense the strength and orientation of magnetic field 114 to determine if golf club head 101 is properly aligned in front of tee 115 and therefore in front of golf ball 116. This value of magnetic field 114 strength and orientation is used to calculate the proximity of striker face 118A to golf ball 116. This proximity value is then stored for later reference as the impact point where striker face 118A is zero distance from golf ball 116. Accelerometers 132 and 133 on control circuits 105 and 119 sense the orientation of golf club 100 by sensing the direction of gravity. A commercially available accelerometer for this purpose is the Analog Devices part number ADXL323 or similar. Acceleration signals from multiple axes accelerometers 132 and 133 are integrated and used to determine club 100 velocity and orientation during a golf swing.

Step 1005 If the sensed value of magnetic field 114 or if the orientation of golf club 100 is not correct, control circuit 119 indicates a red light on LED 122 and the golfer cannot proceed with a golf swing until the error is corrected. This safety feature disables golf club 100 if it is not being used properly. For example if a golfer accidentally presses initialization switch 107 and then strikes golf club head 101 on his shoe to dislodge dirt, this safety feature would disable golf club 100 and prevent accidental firing.

Step 1006 If the strength and orientation of magnetic field 114 and the orientation of golf club 100 are both correct, a green light is indicated on LED 122 and the golfer knows he may proceed into a back swing in a normal manner. If golf club 100 has been programmed to be used in a swingless manner, then the following steps 1007 through 1012 are skipped and the golfer presses and holds switch 107 which gives the firing command as shown in step 1016.

Step 1007 Accelerometers 132 and 133, and magnetic field sensors 112 and 113 sense the back swing motion, and golf ball 116 proximity, as another safety feature to assure that golf club 100 is being used in a correct manner.

Step 1008 If an improper back swing is sensed by accelerometers 132 and 133 or by magnetic field sensors 112 and 113, a red light is indicated on LED 122 and golf club 100 is disabled from firing until the error is corrected.

Step 1009 If a proper back swing is sensed by accelerometers 132 and 133, and by magnetic field sensors 112 and 113, the forward swing is monitored by those same sensors for a proper fore swing. This is a safety feature to disable golf club 100 for improper use.

The determination of improper use can be based on safety or functional parameters from the following list or others;

a. Improper starting orientation
b. improper swing direction
c. Swinging too fast
d. Swinging too slow
e. Swinging erratically
f. Swinging the wrong direction
g. Taking too much time
h. Hitting the ground
i. Not swinging accurately
j. Incorrect proximity to a golf ball
k. Not being proximate to a golf ball
l. Not returning club head accurately to the initial starting point During the forward swing the approach velocity of golf club head 101 is determined from the slope 1105 of curve 1101 using common differentiation or slope measuring techniques. The time of impact 1106 with golf ball 116 is then calculated based on the slope 1105 of curve 1101 using common linear or non-linear extrapolation or other common mathematical techniques.

Step 1010 If an improper fore swing is sensed by accelerometers 132 and 133 or magnetic field sensors 112 and 113, a red light is indicated on LED 122 and golf club 100 is disabled from firing until the error is corrected.

Steps 1011 and 1012 If a proper fore swing is sensed by accelerometers 132 and 133 and magnetic field sensors 112 and 113, The trigger time 1108 is calculated based on the predicted time of impact 1106, the approach velocity determined from slope 1105, and the pre triggering time 1107, which is derived from the desired golf shot distance 1203, and the response characteristic curve 1201 of FIG. 12.

Step 1013 At the determined trigger time 1108, the firing command is given. This begins the sequence of events to deliver the desired assistive energy from flywheels 120 and 121 to golf ball 116.

Step 1014 The sequence of events to deliver the desired assistive energy from flywheels 120 and 121 to golf ball 116 after the firing command is given can take several milliseconds or more to accomplish and includes the following steps:

1. Turing on a switch to activate trigger coils 127 and 129.
2. Ramping up current in trigger coils 127 and 129.
3. Pulling trigger sears 128A and 130A from grooves 117A.
4. Spring 131 pushing sliding ram 117 forward.
5. Engaging sliding ram 117 between flywheels 120 and 121.
6. Accelerating ram 117 and striker 118 toward golf ball 116.

Step 1015 Striker face 118A then impacts golf ball 116 thereby delivering the desired assistive energy to golf ball 116 and adding the desired incremental velocity.

Figure 25:
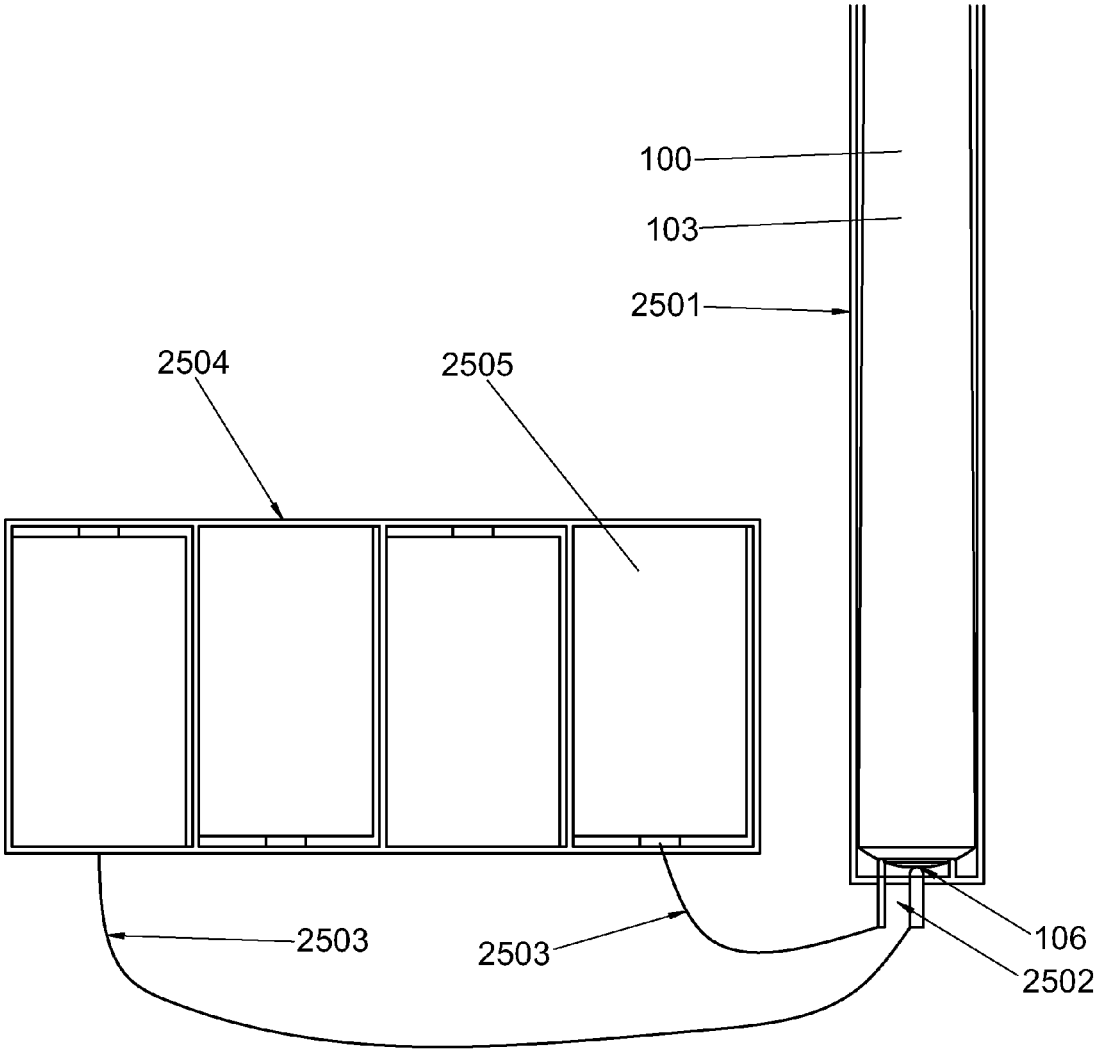
FIG. 25 is a cross sectional view of storage tube 2501 and auxiliary battery pack 2504, which is used for storage and electrical communication with golf clubs 100, 1300, and 1900.

Many common golf bags are designed with storage tubes for each club, to keep clubs organized and separated from each other while stored in a golf bag. FIG. 25 is a cross sectional view of the bottom portion of such a storage tube 2501 which further includes electrical contacts 2502 which mate with the electrical contacts 106 on the end of grip 103 of golf club 100. Tube 2501 would be used in place of a common storage tube in a golf bag for the purpose of connecting with and supplying electrical energy to golf club 100 when it is placed in tube 2501. Battery pack 2504 contains one or more batteries 2505 and is connected to contacts 2502 with wires 2503.

Normally golf club 100 would be stored in tube 2501 in a common golf bag (not shown) when not in use, or between shots during a golf game. Battery pack 2504 would normally be located in a pocket of a common golf bag, and would supply electrical energy for recharging batteries 104 between golf shots or between golf games. This auxiliary battery pack 2504 can therefore eliminate or minimize the size requirements of batteries 104 in grip 103.

Figure 26:
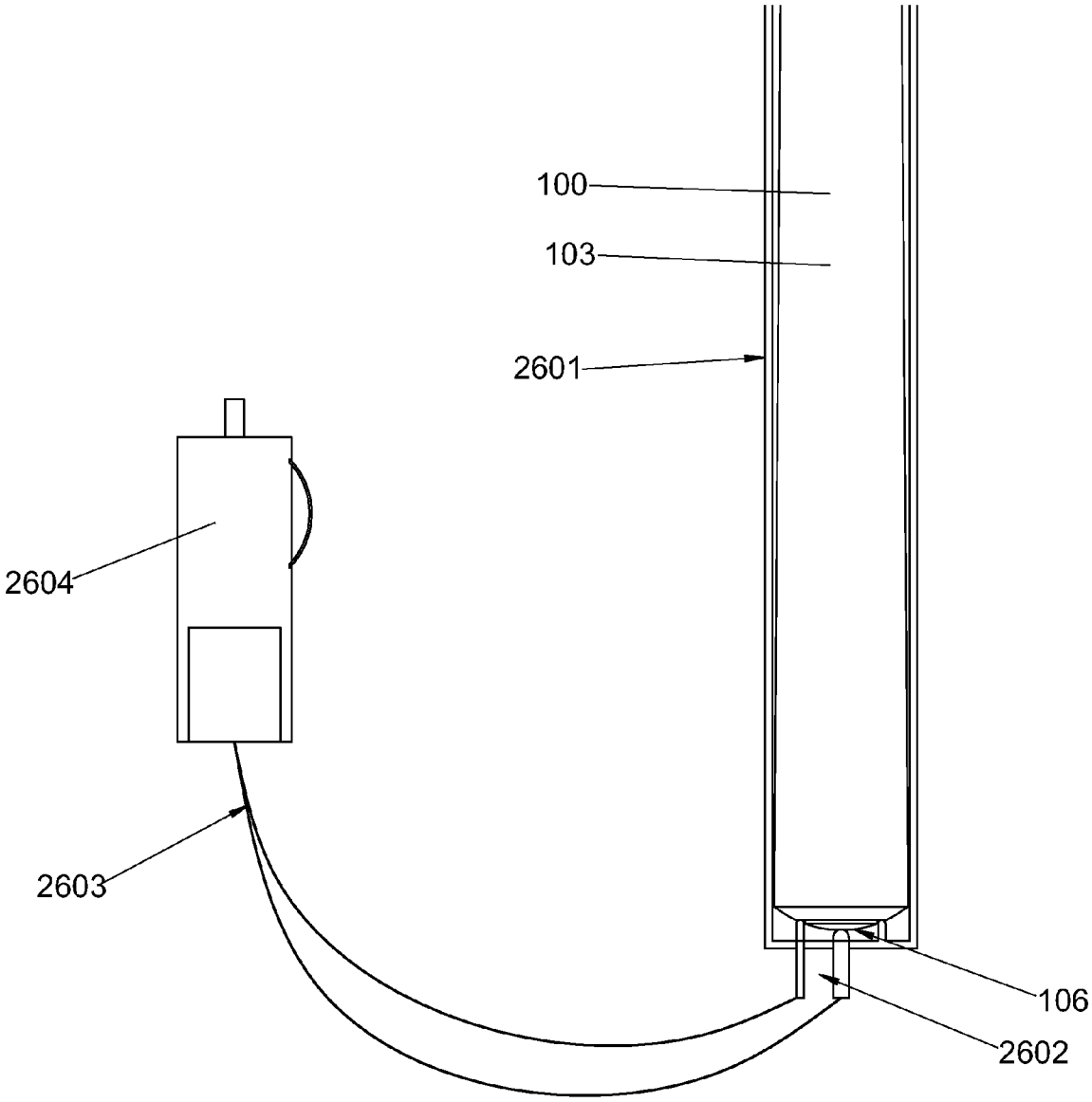
FIG. 26 is a cross sectional view of storage tube 2601 and auxiliary power connection 2604, which is used for storage and electrical communication with golf clubs 100, 1300, and 1900.
Figure 27:
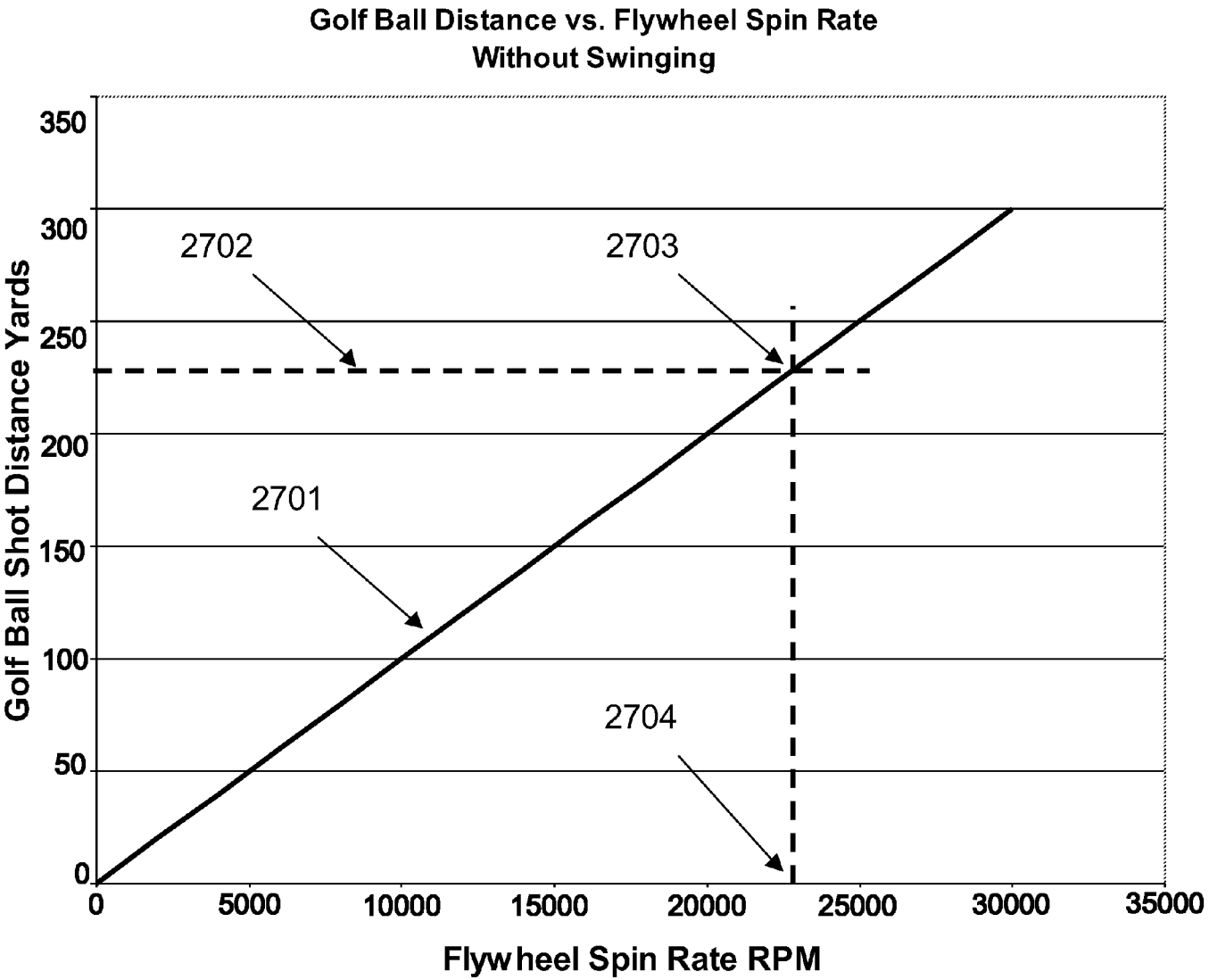
FIG. 27 is a graph of the relationship between flywheel spin rate and golf ball shot distance when the embodiment of FIG. 1 is being used in a swingless manner. This relationship is predetermined for a golf club design and is stored in control electronics for the determination of flywheel spin rate prior to each swingless golf shot to achieve the desired distance.
Figure 28:
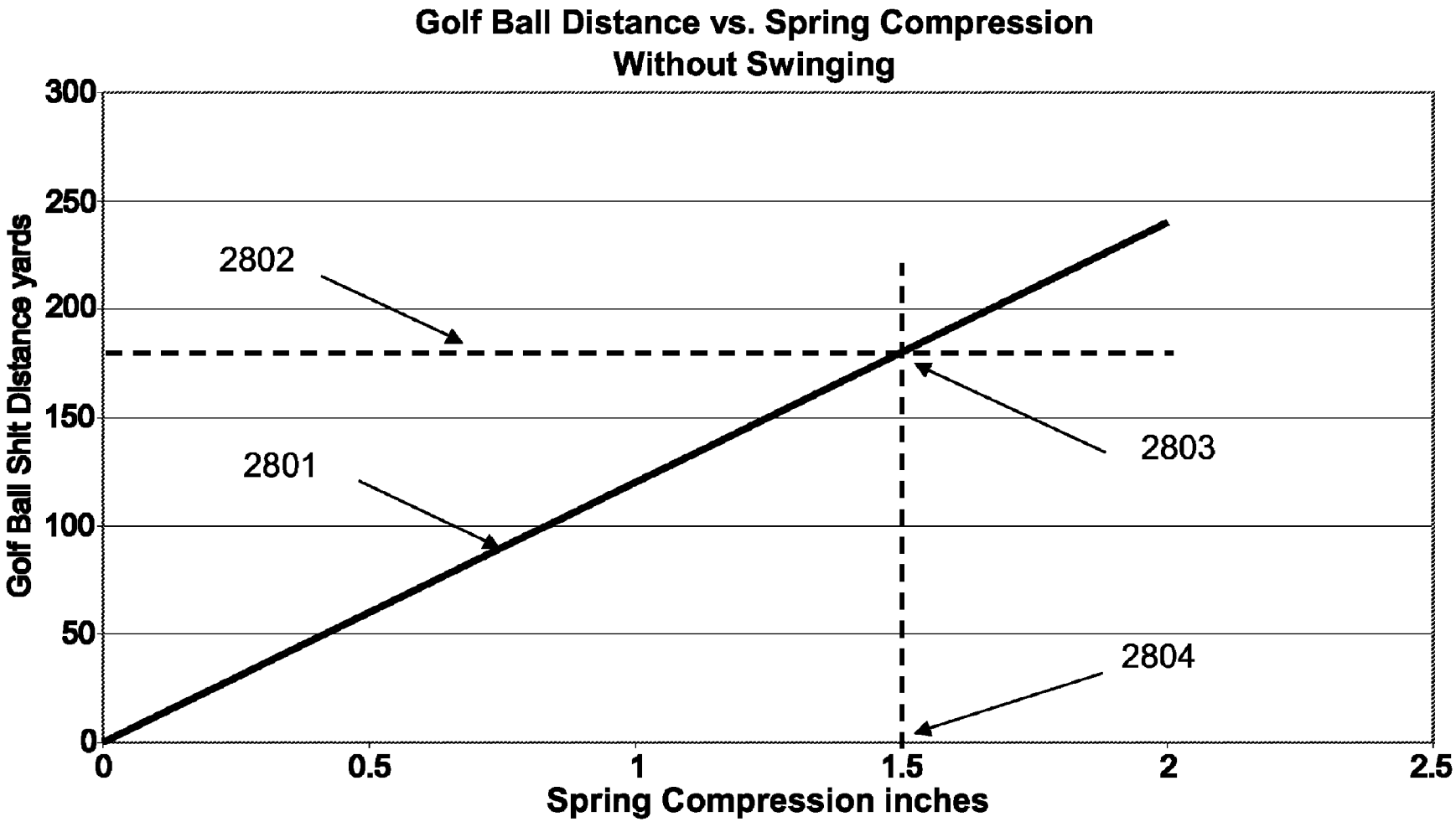
FIG. 28 is a graph of the relationship between spring compression and golf ball shot distance when the embodiment of FIG. 13 is being used in a swingless manner. This relationship is predetermined for a golf club design and is stored in control electronics for the determination of spring compression prior to each swingless golf shot to achieve the desired distance.
Figure 29:
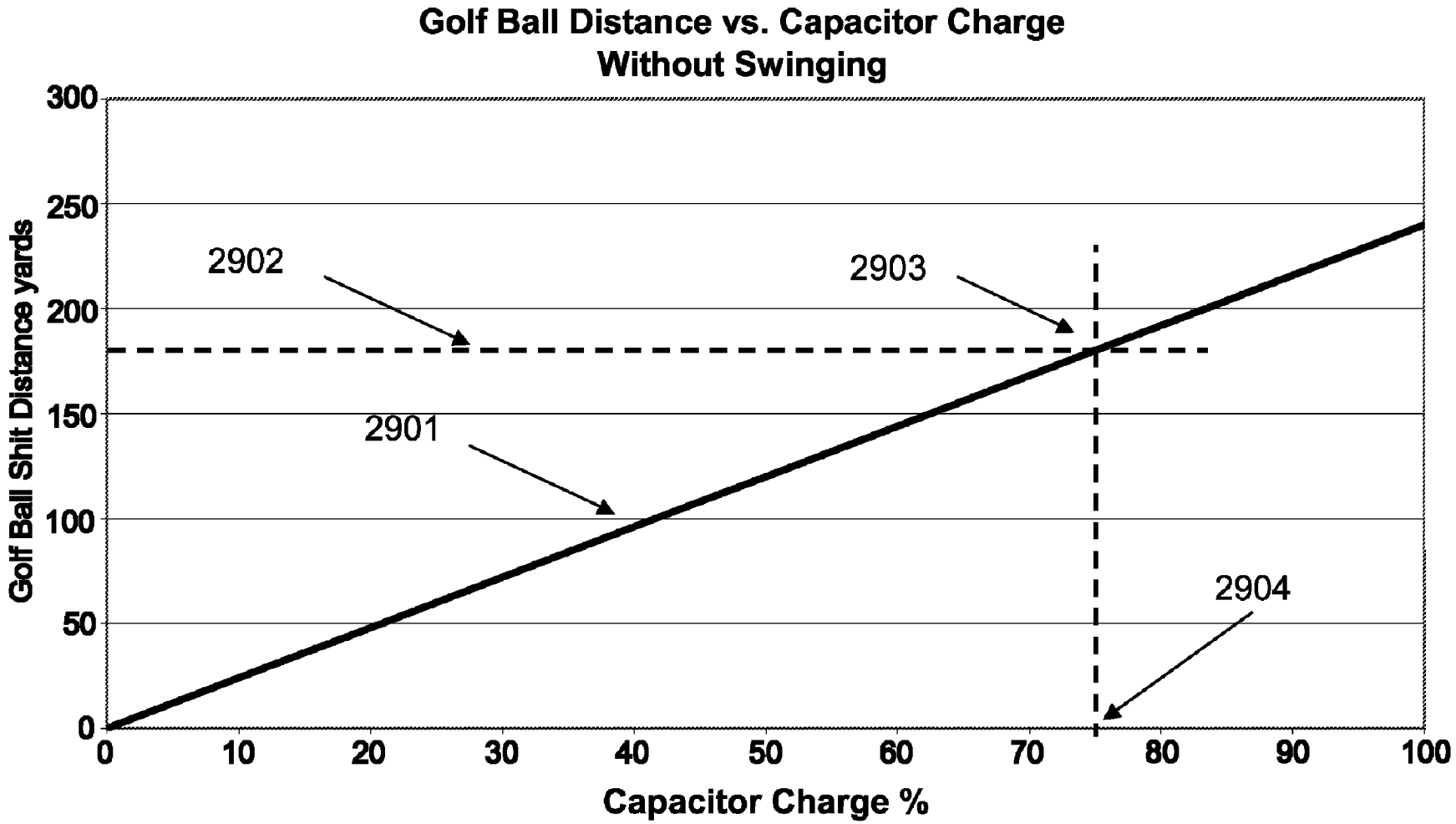
FIG. 29 is a graph of the relationship between capacitor charge amount and golf ball shot distance when the embodiment of FIG. 19 is being used in a swingless manner. This relationship is predetermined for a golf club design and is stored in control electronics for the determination of capacitor charge prior to each swingless golf shot to achieve the desired distance.

FIG. 26 shows a similar storage tube 2601 including electrical contacts 2602 and wires 2603 for the conveyance of electrical energy to golf club 100 from an auxiliary power connection 2604. Connection 2604 is a common cigarette lighter type connection that would commonly be found on a golf cart or vehicle and would normally supply 12 volts DC to golf club 100 when golf club 100 is place in storage tube 2601. Power from auxiliary power connection 2604 can therefore eliminate or minimize the size requirements of batteries 104 in grip 103.

In addition to supplying power to golf club 100, contacts 2502 or 2602 can also convey digital communications with golf club 100 for the purpose of communication and programming control circuits 105 and 119 with a laptop or similar type computer (not shown).

Figure 13:
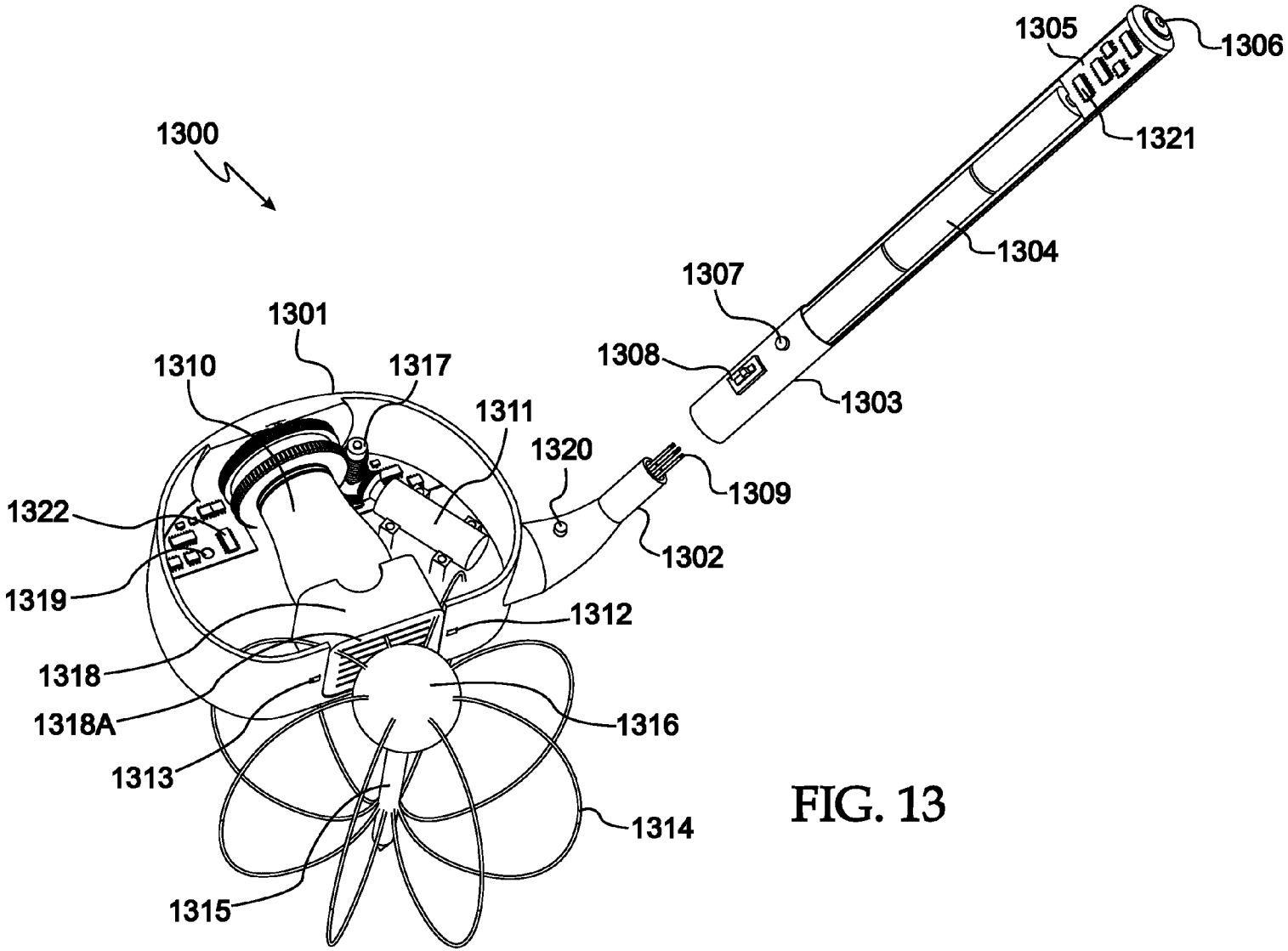
FIG. 13 is an isometric view of the major components of one preferred embodiment of the invention where the velocity generating transducer is an electric motor that compresses a spring through the use of a force amplifying gear train. The top cover of golf club head 1301, most of the length of shaft 1302, and a section of grip 1303 have been removed for visual clarity of the components contained therein. The embodiment is shown in position in front of a golf ball 1316 as it would normally be used.

Another embodiment of the present invention describes herewith. FIG. 13 shows golf club 1300 which is an assistive energy type golf club where the assistive energy for each golf shot is supplied by electrical energy from batteries 1304, then converted into mechanical energy in the form of a compressed spring 1310 through force amplifying gear train 1317. The major components of golf club 1300 are golf club head 1301, shaft 1302, and grip 1303.

Grip 1303 includes one or more batteries 1304 which store electrical energy for one or more golf shots. It was earlier stated that one AA size alkaline battery holds enough energy for an entire golf game. However, multiple batteries 1304 are here connected together in various ways, to provide voltage and current supply compatible with control electronics circuit 1305, circuit 1319, and motor 1311. Control electronics circuits 1305 and 1319 provide control functions including battery 1304 monitoring and recharging, golf club 1300 orientation and motion sensing using accelerometers 1321 and 1322, support for activation switch 1307, and distance selection switch 1308, program and algorithm communication, storage and execution, and other functions. Electrical contact 1306 provides electrical connection between golf club 1300 and auxiliary power and communications when golf club 1300 is placed into an associated storage receptacle tube 2501 or 2601 as was earlier described.

Club head 1301 is connected to grip 1303 by shaft 1302 which includes wires 1309 for the conveyance of electrical signals between grip 1303 and golf club head 1301. The top cover of golf club head 1301, most of the length of shaft 1302, and a section of grip 1303, have been removed for visual clarity. Golf club head 1301 includes main spring 1310 which temporarily stores then releases assistive energy for each golf shot in the form of compressed spring energy. Spring 1310 is here designed to be compressed for energy storage, but could alternately be designed to be extended for energy storage with the same results.

Figure 14:
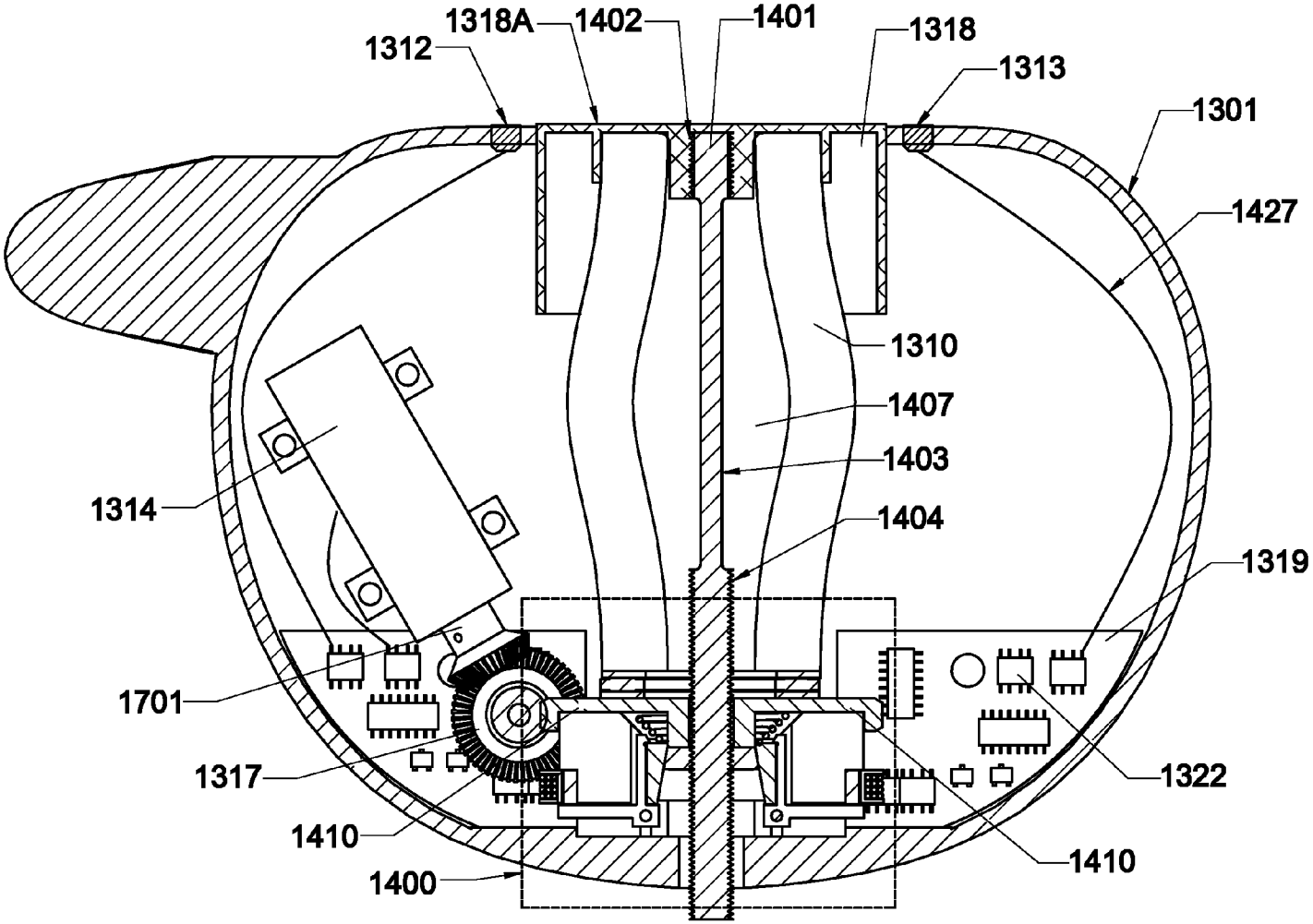
FIG. 14 is a close up view of golf club head 1301 as shown in FIG. 13. The view shows the cross section of the components within golf club head 1301 in their cocked positions ready to fire.
Figure 15:
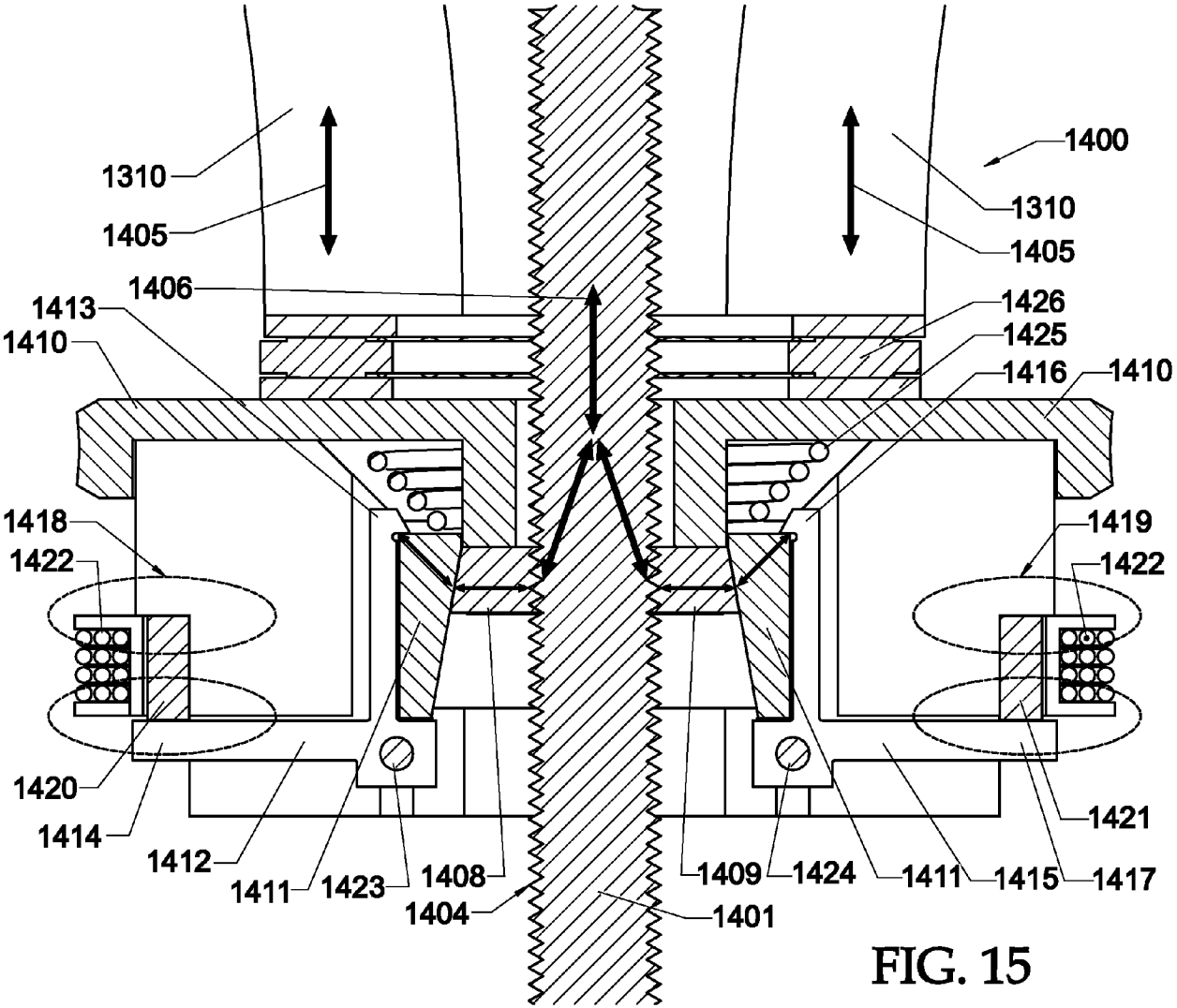
FIGS. 15 and 16 are close up views of the trigger mechanism of golf club head 1301 as shown inside the dashed line area 1400 of FIG. 14.

On FIGS. 13, 14, and 15, main spring 1310 is made of polyurethane material having a Shore hardness value of around 90A to 95A. Spring 1310 is in the form of a thick walled tube having an inner diameter 1407, and is connected between thrust bearing 1426 at its rear end, and striker 1318 at its forward end, so that it can propel striker 1318 toward golf ball 1316. Main spring 1310 bulges visibly outward into a barrel shape when compressed as shown in FIGS. 13 and 14. Other types of compressible or extensible springs can be used including metal coil springs, compressed gas springs and other types.

Main spring 1310 is designed to store a minimum of 100 foot pounds of energy by compressing its length by about two inches. The energy stored in a compressed spring is a function of the spring rate times the length of compression squared according to equation 2 below. To achieve the required 100 foot pounds of energy storage, main spring 1310 is designed to have a spring rate of about 600 pounds per inch of compression so that over two inches of compression it will store 1200 inch pounds or 100 foot pounds of energy according to the energy equation 2;

$$E = \frac{1}{2} * K * X^2 \qquad \text{Eq. 2}$$

$$E = \frac{1}{2} * 600 * 2^2$$

$$E = 1200 \text{ inch-pounds}$$

$$E = 100 \text{ foot-pounds}$$

Where:

E=Stored energy of compressed spring 1310.

K=Spring rate of spring 1310.

X=Length of compression of spring 1310.

Figure 16:
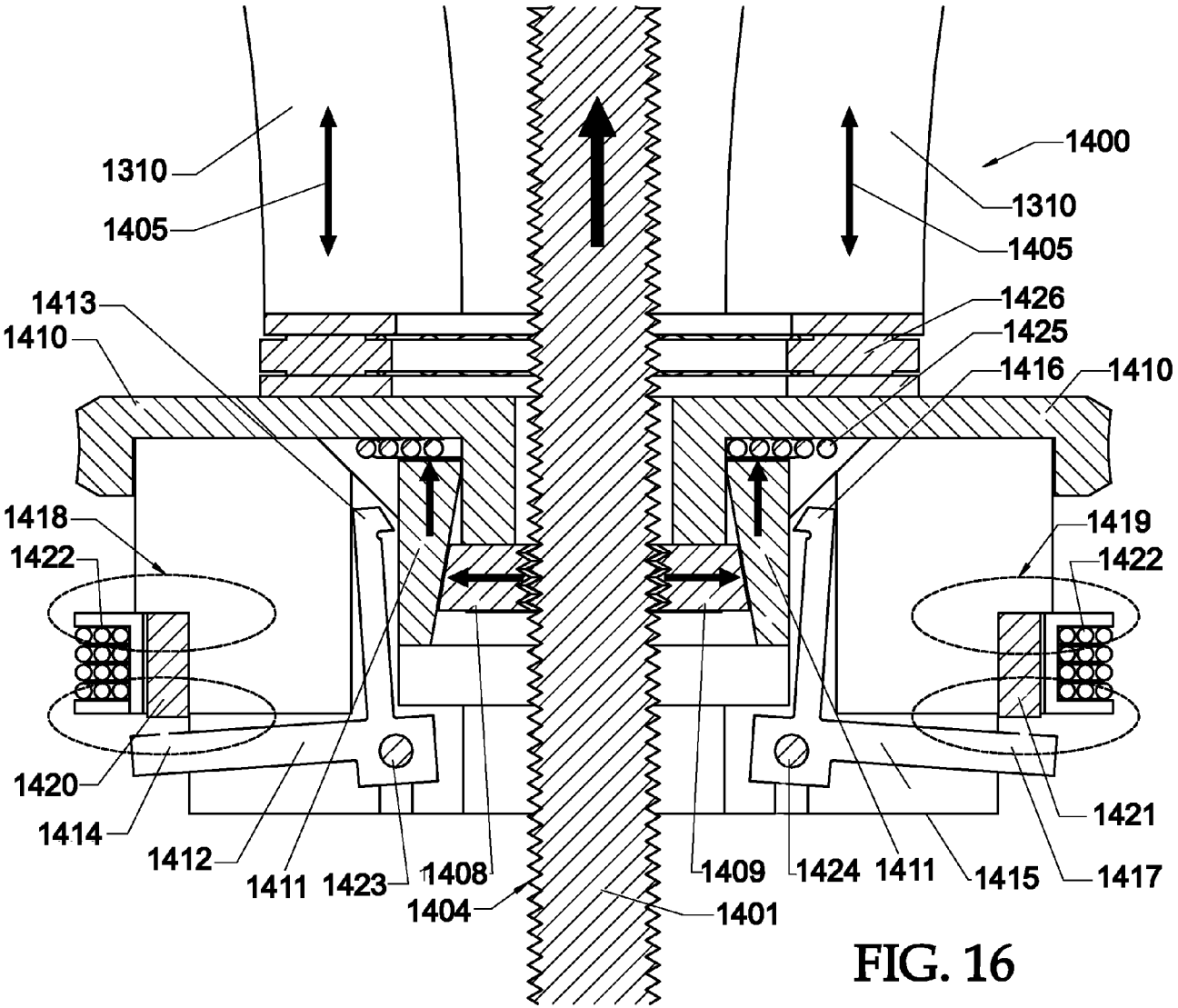

The forward end of spring 1310 is held in place by striker 1318. In FIGS. 14, 15, and 16, threaded rod 1401 is attached by threads 1402 at its forward end to striker 1318 and acts to compress and hold spring 1310 by pulling back on striker 1318 with tensile force 1406. Threaded rod 1401 has a non-threaded section 1403 of smaller diameter for weight reduction. The threads 1404 of threaded rod 1401 are designed to be pulled and held by the triggering mechanism 1400 within the dashed line area of FIG. 14 and more clearly shown in FIGS. 15 and 16.

On FIGS. 14, 15, and 16, the threads 1404 of threaded rod 1401 are gripped and held by sliding sears 1408 and 1409 which are arranged around, and engaged with the threads 1404 of threaded rod 1401. Sliding sears 1408 and 1409 are made from a bushing that is tapered on the outside of its diameter, and tapped on the inside of its diameter to match the threads 1404 of threaded rod 1401, then cut into two or more pieces and arranged like jaws of a chuck around the threads 1404 of threaded rod 1401. Sliding sears 1408 and 1409 are held in slots in the center hub area of worm gear 1410 to allow radial movement as necessary to engage or disengage with the threads 1404 of threaded rod 1401. The radial movement of sliding sears 1408 and 1409 is controlled by sliding cup 1411 which is tapered on its inner diameter to match the outer taper of sliding sears 1408 and 1409.

Sliding cup 1411 is held in place in a cocked position, shown in FIG. 15, by the hooked ends 1413 and 1416 of triggers 1412 and 1415. In the cocked position, a portion of tensile force 1406 in rod 1401 is transferred through sliding sears 1408 and 1409 onto sliding cup 1411, and then onto the hooked ends 1413 and 1416 of triggers 1412 and 1415. On FIGS. 14, 15, and 16 the distal ends 1414 and 1417 of triggers 1412 and 1415 are held in place by magnetic attraction with magnetic fields 1418 and 1419 emanating from arc magnets 1420 and 1421.

Club head 1301 further includes proximity sensors 1312 and 1313 which are hall effect sensors positioned to sense magnetic field 1314 emanating from golf tee 1315. Wires 1427 are used to electrically interconnect components within club head 1301. Golf tee 1315 is made of or contains a magnet or magnetic field producing material such as Neodymium Iron Cobalt, or a battery and coil, for the creation of magnetic field 1314. Golf ball 1316 is perched atop tee 1315 in a normal manner so that proximity sensors 1312 and 1313 can thereby determine the proximity of golf ball 1316 by sensing the strength and orientation of magnetic field 1314. The proximity of golf ball 1316 is used to determine when to give the firing command to release assistive energy as further explained hereinafter. By sensing and comparing signals from multiple proximity sensors 1312 and 1313, the proximity of golf ball 1316 can be accurately determined relative to the center of striker face 1318A.

FIG. 11 shows curve 1101 representing the proximity of golf ball 1316 to striker face 1318A as a function of time during a normal golf swing as it did for the embodiment of FIG. 1. Area 1102 shows the initial zero distance value where the golfer addresses ball 1316 and places striker face 1318A behind and just touching golf ball 1316. Area 1103 shows the backswing, and area 1104 shows the fore swing. From this curve 1101, the approach velocity of club head 1301 toward golf ball 1316 can be determined from the slope 1105 of curve 1101 using signal differentiation or slope calculation methods that are well known. The time at impact 1106 can then be predicted where curve 1101 intersects its initial zero distance value 1102 by using linear or non-linear extrapolation methods that are well known. Curve 1101 is used to calculate the time to give the firing command 1108 which is normally prior to golf ball impact 1106 by a pre trigger time 1107 that is calculated as hereinafter explained.

Many types of sensors and transmitters can be used for this golf ball proximity sensing purpose including ultrasonic type, laser type, radar type, accelerometer type, metal detector type, magnetic type, contact type, light emitting diode type, and others. For example sensor 1313 can be an ultrasonic receiver used in conjunction with an ultrasonic transmitter 1312. As another example sensor 1313 can be a laser type receiver used in conjunction with a laser type transmitter 1312. As another example sensor 1313 can be a metal detector type receiver used in conjunction with a metal detector type signal transmitter 1312, and ball 1316 would be a common golf ball having a metal core. The details of the proximity sensor may vary so long that it, along with control electronics 1319, can determine when to give the firing command to release assistive energy for the desired effect. Normally the time to give the firing command is a number of milliseconds prior to golf ball impact because of inherent delay characteristics of a specific golf club design. Inherent delays in the embodiment of FIG. 13 include the following steps which take place after the firing command is given and before impact with golf ball 1316. The total time represented by these steps can be several milliseconds or more:

1. Turn-on time for a switch to apply current to coil 1422.
2. Ramping up the current in trigger coil 1422.
3. Pulling triggers 1412 and 1415.
4. Accelerating sliding sears 1408 and 1409 and cup 1411.
5. Disengaging sliding sears 1408 and 1409 from threads 1404.
6. Accelerating threaded rod 1401 and striker 1318 forward.
7. Impacting golf ball 1316 with striker face 1318A.

By testing a golf club design for resulting golf ball distance vs. pre impact triggering time at a specific approach velocity, a characterization curve 1201 is created and the information is stored in control circuit 1319 for a determination of when to give the firing command during a golf swing. FIG. 12 is a graph of such a characterization curve 1201 of the present invention. FIG. 12 shows how the resulting golf ball distance varies as a function of when the firing command is given prior to golf ball impact. Curve 1201 is representative of a specific approach velocity and curve 1202 is representative of a different approach velocity. Curves 1201 and 1202 are made by testing club 1300 under specific fairway and weather conditions, and results will vary for other conditions. Families of curves for different approach velocities are determined and the data stored in control electronics 1319 for determination of when to give the firing command during a golf swing. By examination of curve 1201 in FIG. 12 the desired distance 1203 of 225 yards, intersects curve 1201 initially at point 1204 which relates to a pretrigger time 1107 of about −0.025 seconds. This means that the desired golf shot distance of 225 yards will be achieved if the firing command is given 0.025 seconds prior to impact time 1106. The firing command would then be given at point 1108 of curve 1101.

The exact shape of characterization curves such as curves 1201 and 1202 are completely dependant on the design of the golf club, and the approach velocity 1105, and specific fairway and weather conditions, and can vary widely from those shown in FIG. 12.

An alternative method of determining when to give a firing command is to use the proximity of golf ball 1316 to striker face 1318A directly. For example, curve 1101 can be used directly by control electronics 1319 to give a firing command when striker face 1318A has reached a prescribed distance from golf ball 1316, without taking into account the response and delay characteristic curve 1201 of club 1300. This alternative method is a simplification and can be used effectively when a golfer has a consistent approach velocity.

Normally the firing command is timed to add incremental velocity to a golf ball, however, the firing command can also be timed to minimize or subtract incremental velocity thereby achieving golf ball velocities and distances that are less than what would be achieved by using golf club 100 without releasing any assistive energy. The purpose of subtracting incremental velocity would be for safety reasons to limit golf shot distance, or for training or demonstration purposes.

On FIG. 16, when the firing command is given, electrical current is caused to flow through coil 1422 which is located in magnetic fields 1418 and 1419, thereby causing a force on coil 1422 which pushes the distal ends 1414 and 1417 of triggers 1412 and 1415 away from their engagement with magnets 1420 and 1421 causing triggers 1412 and 1415 to rotate about trigger pins 1423 and 1424. This rotation disengages the hooked ends 1413 and 1416 of triggers 1412 and 1415 from sliding cup 1411 allowing it to move forward. The force causing sliding cup 1411 to move forward is a component of force 1406 acting on the tapered inside diameter of sliding of cup 1411. The angle of this taper can be adjusted to control the response time of the triggering mechanism 1400.

Tensile force 1406 in threaded rod 1401 pushes sliding sears 1408 and 1409 radially outward against the taper of sliding cup 1411 causing it to move forward and compress return spring 1425. As sliding cup 1411 moves forward, sliding sears 1408 and 1409 move radially outward disengaging them with the threads 1404 of threaded rod 1401 allowing it to move forward. When sliding sears 1408 and 1409 have fully disengaged with the threads 1404 of threaded rod 1401, threaded rod 1401 along with striker 1318 then accelerate forward toward golf ball 1316 due to compression force 1405 in spring 1310. Striker face 1318A then impacts golf ball 1316 at the prescribed time and with a prescribed force, transferring the stored energy of spring 1310 into golf ball 1316 adding incremental velocity to golf ball 1316.

Figure 17:
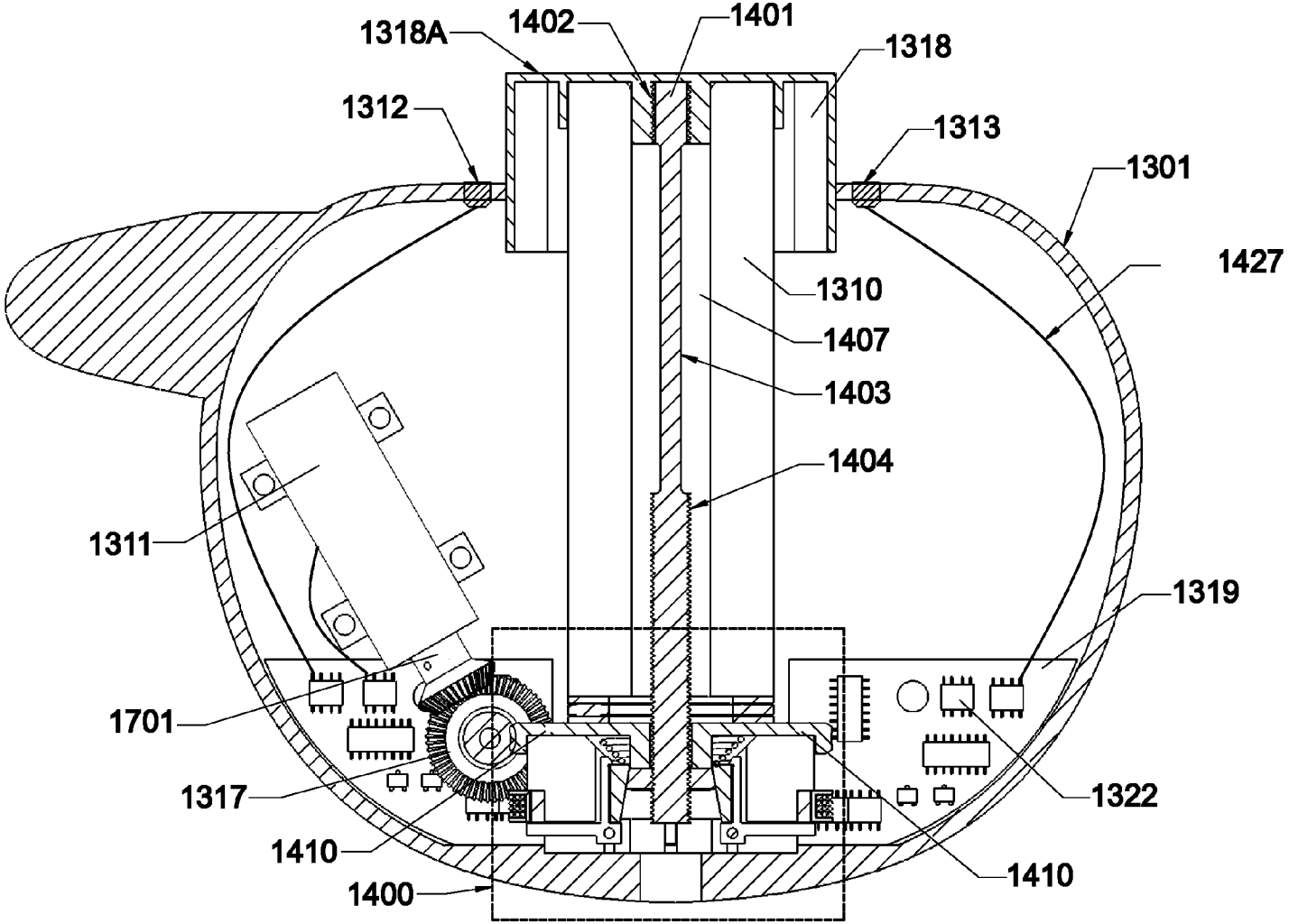
FIG. 17 is a cross section view of golf club head 1301 as shown in FIGS. 13 and 14. The view shows the cross section of golf club head 1301 after striking a golf ball.

FIG. 17 shows the arrangement of components in golf club head 1301 just after completion of a golf shot where main spring 1310, threaded rod 1401, and striker 1318 have been extended forward to their maximum extent. Return spring 1425 of FIGS. 15 and 16 has pushed sliding cup 1411 backward forcing sliding sears 1408 and 1409 back into engagement with threads 1404 of threaded rod 1401. All the components trigger mechanism 1400 have been returned to their original cocked positions 10 represented by FIG. 15, except striker 1318, spring 1310, and thread 1401, which remain extended forward and need to be recocked prior to the next golf shot. Golf club head 1301 is normally left uncocked until a golfer is ready to begin the next golf shot by pressing activation switch 1307 to begin the cocking sequence. Golf club head 1301 is normally left in an uncocked 15 condition for safety reasons.

On FIGS. 13, 15, and 17, to accomplish recocking, the golfer presses activation switch 1307 which activates electric motor 1311 thereby turning force amplifying gear train 1701 and 1317 which turns worm gear 1410 and sliding sears 1408 and 1409 around the threads 1404 of threaded rod 1401 thereby pulling threaded rod 1401 backward by threading action. Main spring 1310, striker 1318, and threaded rod 1401 are isolated from turning by thrust bearing 1426.

As a design example, threads 1404 of threaded rod 1401 are threaded with 32 threads per inch and therefore requires (2×32) or 64 turns to pull it 2 inches for recocking. Gear train 1317, 1701, and 1410 has a gear reduction of about 100 to 1, and motor 1311 is designed to run at about 10,000 RPM. Therefore motor 1311 must turn (64×100), or 6400 revolutions to move threaded rod 1401 by 2 inches. Motor 1311 running at 10,000 RPM will therefore take about 38 seconds to accomplish recocking.

When threaded rod 1401 has been pulled back to its cocked position as represented by FIG. 14, motor 1311 is turned off by control circuit 1319, and golf club head 1301 is ready for the next golf shot.

Any type of motor can be used to cause gear train 1317, 1701, and 1410 to turn including non-electrical and manually driven motors or hand cranks, however electric motors are preferred for motor 1311. Also force amplifying gear train 1317 could be replaced by force amplifying pulleys or levers or hydraulic or pneumatic actuators or other force amplifiers.

Figure 18:
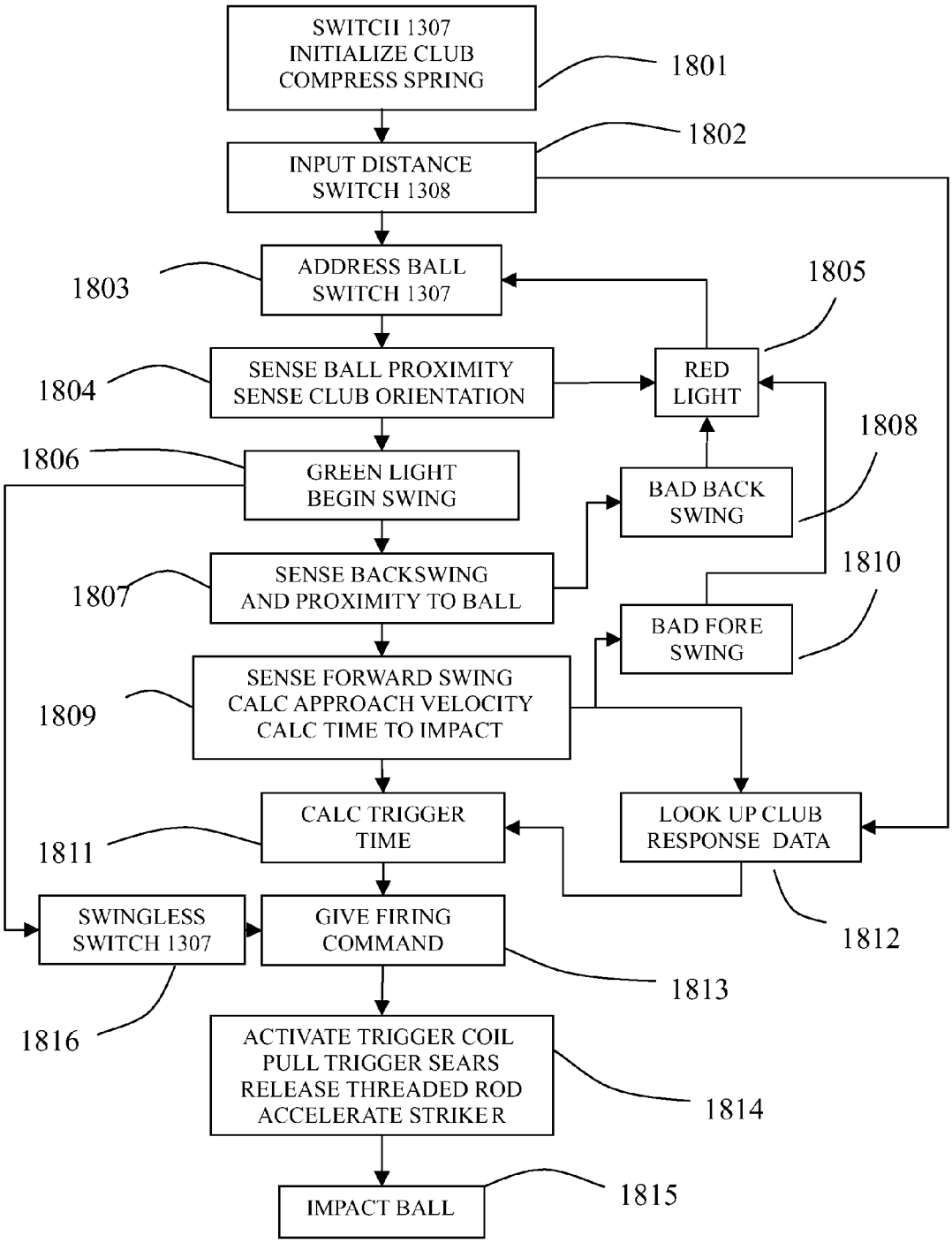
FIG. 18 is a flow chart outlining the steps during the use of the embodiment of FIG. 13.

FIG. 18 is a block diagram of the sequence of events which happen during the use of the embodiment of FIG. 13. The description of each step in the sequence of FIG. 18 is next described.

FIG. 18 Reference Descriptions:

Step 1801 The golfer first presses switch 1307 approximately 38 seconds or more prior to the golf shot. This initializes golf club 1300 and activates control circuits 1305 and 1319 to turn on electric motor 1311 which turns force amplifying gear train 1317, 1701, and 1410 and compresses spring 1310 into a cocked position. This may take 38 seconds or so to accomplish. The golfer can use this time to place golf ball 1316 on tee 1315.

Step 1802 The golfer selects the desired golf shot distance 1203 of FIG. 12 for example 225 yards, using distance selection switch 1308. This inputs a desired distance value 1203 that will be used later during the calculation of the trigger time when the firing command is given. If golf club 1300 has been programmed to be used in a swinging manner, spring 1310 is compressed by an amount adequate for the selected golf shot distance 1203, for example two inches. If golf club 1300 has been programmed to be used in a swingless manner, spring 1310 is compressed by an amount determined by curve 2801 and the desired golf shot distance 2802, which occurs at point 2803 and indicates a spring compression 2804 of 1.5 inches on FIG. 28.

Step 1803 The golfer addresses the golf ball in a normal manner by placing the striker face 1318A of striker 1318 directly behind and just touching golf ball 1316, and presses switch 1307 to sense the proximity of golf ball 1316.

Step 1804 Proximity sensors 1312 and 1313 sense the strength and orientation of magnetic field 1314 to determine if golf club head 1301 is properly aligned in front of tee 1315 and therefore in front of golf ball 1316. This value of magnetic field 1314 strength and orientation is used to calculate the proximity of golf ball 1316 to striker face 1318A which is stored for later reference as the impact point where striker face 1318A is zero distance from golf ball 1316. Accelerometers 1321 and 1322 on control circuits 1305 and 1319 sense the orientation of golf club 1300 by sensing the direction of gravity. Acceleration signals from multiple axes accelerometers 1321 and 1322 are integrated and used to determine club 1300 velocity and orientation during a golf swing.

Step 1805 If the sensed value of magnetic field 1314 or if the orientation of golf club 1300 is not correct, control circuit 1319 indicates a red light on LED 1320 and the golfer cannot proceed with a golf swing until the error is corrected. This safety feature disables golf club 1300 if it is not being used properly. For example if a golfer accidentally presses initialization switch 1307 and then strikes golf club head 1301 on his shoe to dislodge dirt, this safety feature would disable golf club 1300 and prevent accidental firing.

Step 1806 If the strength and orientation of magnetic field 1314 and the orientation of golf club 1300 are both correct, a green light is indicated on LED 1320 and the golfer knows he may proceed into a back swing in a normal manner. If golf club 1300 has been programmed to be used in a swingless manner, then the following steps 1807 through 1812 are skipped, and the golfer presses and holds switch 1307 which gives the firing command as shown in step 1816.

Step 1807 Accelerometers 1321 and 1322 then sense the back swing motion, and magnetic field sensors 1312 and 1313 sense golf ball 1316 proximity as another safety feature to assure that golf club 1300 is being used in a proper manner.

Step 1808 If an improper back swing is sensed by accelerometers 1321 and 1322, or by magnetic field sensors 1312 and 1313, a red light is indicated on LED 1320 and golf club 1300 is disabled from firing until the error is corrected.

Step 1809 If a proper back swing is sensed by accelerometers 1321 and 1322, and by magnetic field sensors 1312 and 1313 like that shown by area 1103 of curve 1101 of FIG. 11, the forward swing is monitored by those same sensors for a proper fore swing. This is a safety feature to disable golf club 1300 for improper use. The determination of what constitutes an improper swing can be based on safety parameters including those on the following list or others;

1. Improper starting orientation:
2. Improper swing direction:
3. Swinging too fast:
4. Swinging too slow:
5. Taking too much time:
6. Swinging erratically:
7. Hitting the ground:
8. Not returning golf club head 1301 accurately to the initial starting point:
9. Not starting proximate a golf ball:
10. Incorrect proximity to a golf ball
11. Or others:

During the forward swing, the approach velocity of golf club head 1301 is determined from slope 1105, and the time of impact 1106 with golf ball 1316 is calculated based on the slope 1105 of curve 1101 using common linear or non-linear extrapolation or other common mathematical techniques.

Step 1810 If an improper fore swing is sensed by accelerometers 1321 and 1322 or by magnetic field sensors 1312 and 1313, a red light is indicated on LED 1320 and golf club 1300 is disabled from firing until the error is corrected.

Steps 1811 and 1812 If a proper fore swing is sensed by accelerometers 1321 and 1322 and by proximity sensors 1312 and 1313 such as area 1104 of curve 1101 on FIG. 11, the trigger time 1108 is calculated based on the predicted time of impact 1106, the approach velocity determined by slope 1105, and the pre triggering time 1107. The pre triggering time 1107 is derived from the desired golf shot distance 1203, and the response characteristic curve 1201 of FIG. 12.

Step 1813 At the determined trigger time 1108, the firing command is given. This begins the sequence of events to deliver the desired assistive energy from main spring 1310 to golf ball 1316.

Step 1814 The sequence of events to deliver the desired assistive energy from main spring 1310 to golf ball 1316 after the firing command is given can take several milliseconds or more to accomplish and includes the following steps:

1. Turing on a switch to activate trigger coil 1422.
2. Ramping up current in trigger coil 1422.
3. Rotating triggers 1412 and 1415.
4. Pushing sliding cup 1411 forward.
5. Disengaging sliding sears 1408 and 1409 from threaded rod 1401.
6. Accelerating rod 1401 and striker 1318 toward golf ball 1316.

Step 1815 Striker face 1318A then impacts golf ball 1316 delivering the desired assistive energy to golf ball 1316 and adding the prescribed incremental velocity.

After the completion of a golf shot, golf club head 1301 is normally left in an uncocked condition as shown in FIG. 17 until the golfer begins the next golf shot. Golf club head 1301 is normally left in an uncocked condition for safety reasons.

It was earlier explained that golf club 100 can be placed into tube 2501 or 2601 when not in use, or between golf shots, and receive electrical energy from auxiliary battery pack 2504 or connection 2604. Similarly, golf club 1300 can be placed into a storage tube 2501 or 2601 when not in use and be similarly connected to auxiliary power and communication sources.

Figure 19:
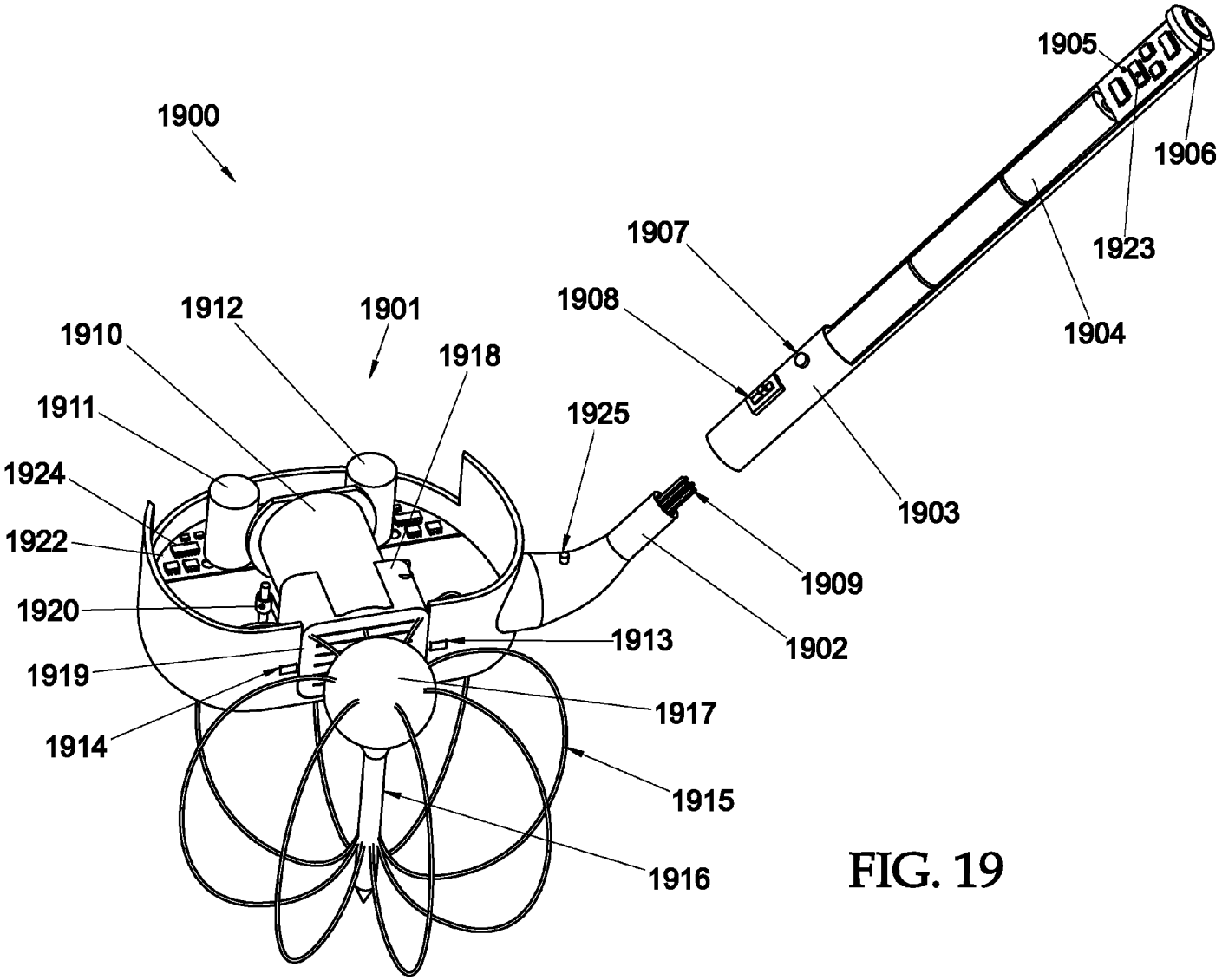
FIG. 19 is an isometric view of a preferred embodiment of the present invention where the velocity generating transducer is a magnet coil combination 1910. Parts of the golf club head 1901 cover, shaft 1902, and grip 1903 have be removed for visual clarity of the components contained therein. The embodiment is shown in position in front of a golf ball 1917 as it would normally be used.
Figure 20:
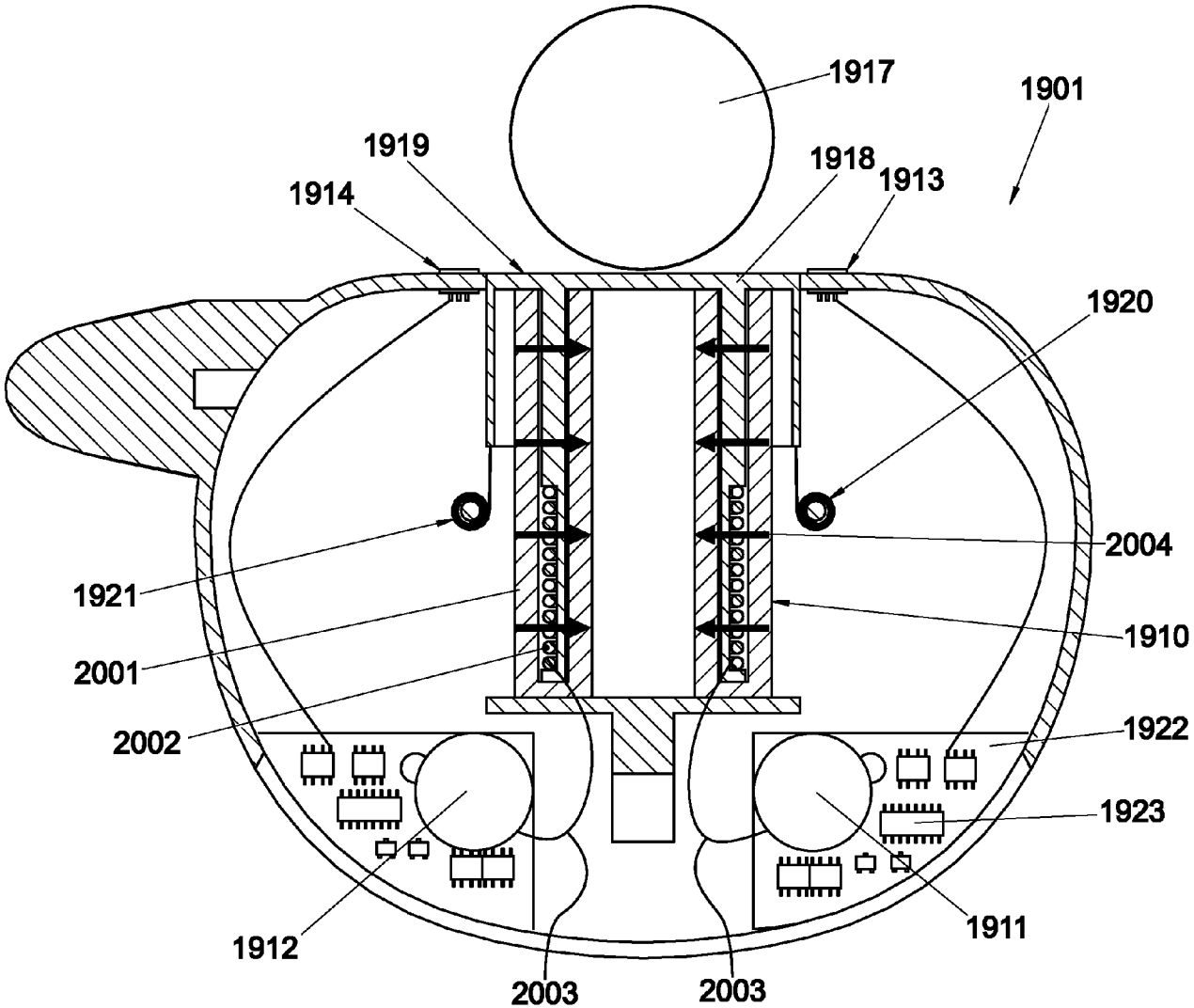
FIG. 20 is a cross sectional view showing the components within the golf club head 1901 of FIG. 19. The components are shown in a ready position just before releasing assistive energy.
Figure 21:
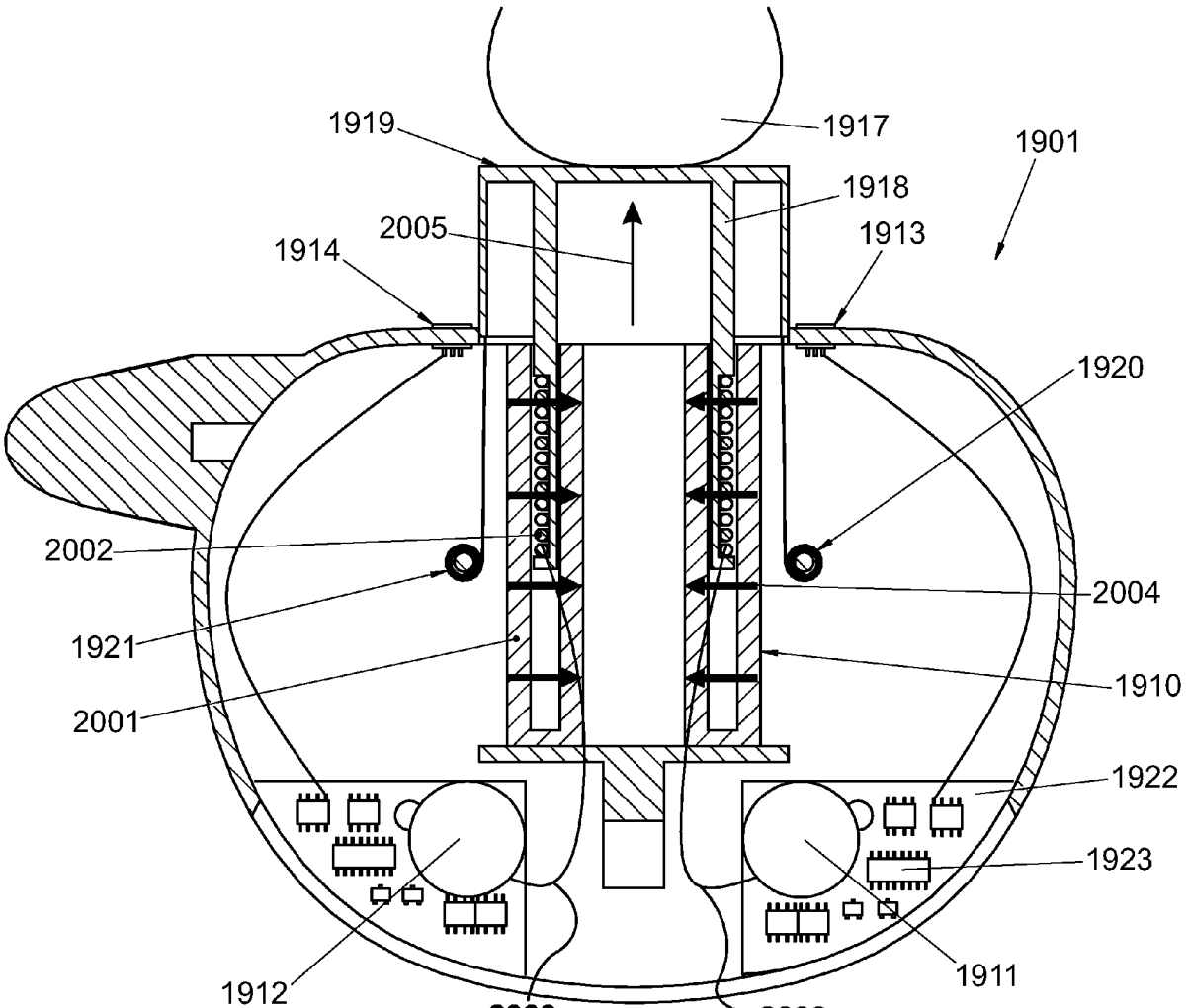
FIG. 21 is a cross sectional view showing the components within the golf club head 1901 of FIG. 19. The components are shown in their positions during the release of assistive energy.

Another exemplary embodiment of the present invention is next described with reference to the drawings. FIGS. 19, 20, and 21 are views of a possible preferred embodiment of the present invention where the assistive energy for each golf shot is supplied in the form of electrical energy from batteries 1904, stored temporarily in capacitors 1911 and 1912 and then converted into mechanical energy by electro-mechanical velocity generating transducer 1910 which uses a magnetic field 2004 created by magnet 2001 and a coil 2002 to create a force to accelerate a striker 1918. The major components of golf club 1900 include golf club head 1901, shaft 1902, and grip 1903.

Grip 1903 includes one or more batteries 1904 which store energy for one or more golf shots. It was earlier stated that one AA size alkaline battery holds enough energy for an entire golf game. However, multiple batteries 1904 are here connected together in various ways, to provide voltage and current supply compatible with control electronic circuits 1905, and 1922, and coil 2002. Control electronic circuits 1905 and 1922 provide control functions including battery 1904 monitoring and recharging, golf club 1900 orientation and motion sensing using accelerometers 1923 and 1924, support for activation switch 1907, and distance selection switch 1908, program and algorithm communication, storage and execution, and other functions. Signals from multiple axes accelerometers 1923 and 1924 are integrated to determine club 1900 velocity and orientation. Electrical contact 1906 provides electrical connection between golf club 1900 and auxiliary power and communications when golf club 1900 is placed into an associated recharging and storage receptacle tube such as tubes 2501 or 2601.

Club head 1901 is connected to grip 1903 by shaft 1902 which includes wires 1909 for the conveyance of electrical signals between grip 1903 and golf club head 1901. Golf club head 1901 includes electro-mechanical velocity generating transducer 1910 which converts electrical energy from capacitors 1911 and 1912 into mechanical energy in the form of accelerating striker 1918 so that striker face 1919 will strike golf ball 1917 with a prescribed force. Capacitors 1911 and 1912 are used to temporarily store and release electrical energy because they can discharge a large electrical current more quickly than typical batteries 1904, and at higher voltages than batteries 1904.

Figure 23:
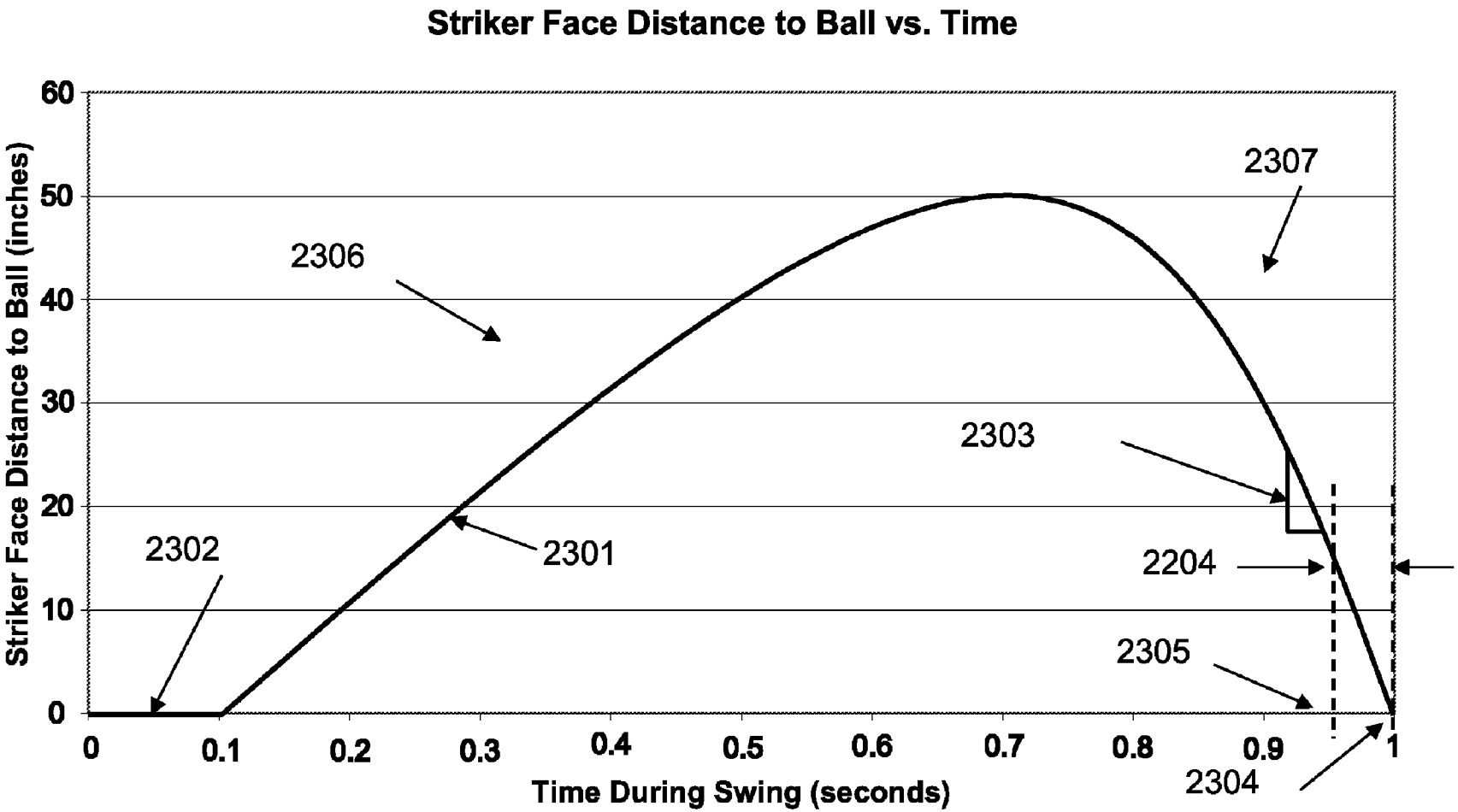
FIG. 23 is a graph of curve 2301 representing the distance between the striker face and the golf ball vs. time that would be sensed by proximity sensors 1913 and 1914 on the golf club head 1901 of FIG. 19 during a normal golf swing.

Club head 1901 further includes proximity sensors 1913 and 1914 which are hall effect sensors positioned to sense magnetic field 1915 emanating from golf tee 1916. Golf tee 1916 is made of or contains magnetic field producing material such as Neodymium Iron Cobalt for the creation of magnetic field 1915. Golf ball 1917 is perched atop tee 1916 in a normal manner where proximity sensors 1913 and 1914 can thereby determine the proximity of golf ball 1917 by sensing the strength of magnetic field 1915. Using multiple proximity sensors 1913 and 1914 on either side of club face 1919, the proximity of golf ball 1917 can be accurately determined relative to the center of club face 1919. The proximity of golf ball 1917 is used to determine when to give the firing command to release assistive energy as further explained hereinafter. FIG. 23 shows curve 2301 representing the proximity of golf ball 1917 to striker face 1919 as a function of time during a normal golf swing, as would be sensed by proximity sensors 1913 and 1914. Area 2302 shows the initial zero distance value where the golfer addresses golf ball 1917 and places striker face 1919 behind and just touching golf ball 1917. Using curve 2301, the approach velocity can be determined from the slope 2303 of curve 2301, and the time at impact 2304 can then be predicted where curve 2301 will intersect its initial zero distance value 2302. This curve 2301 is used to calculate the time to give the firing command 2305 which is normally prior to golf ball impact 2304 by a pre trigger time 2204.

An alternative method of determining when to give a firing command is to use the proximity of golf ball 1917 to striker face 1919 directly. For example, curve 2301 can be used directly by control electronics 1922 to give a firing command when striker face 1919 has reached a prescribed distance from golf ball 1917, without taking into account the response and delay characteristic curve 2201 of club 1900. This alternative method is a simplification and can be used effectively when a golfer has a consistent approach velocity.

Many types of sensors can be used for this golf ball proximity sensing purpose including ultrasonic type, laser type, radar type, accelerometer type, metal detector type, magnetic type, contact type, light emitting diode type, and others. For example sensor 1913 can be an ultrasonic receiver used in conjunction with an ultrasonic transmitter 1914. As another example sensor 1913 can be a laser type receiver used in conjunction with a laser type transmitter 1914. As another example sensor 1913 can be a metal detector type receiver used in conjunction with a metal detector type signal transmitter 1914, and ball 1917 would be a common golf ball having a metal core. The details of the proximity sensor may vary so long as it, along with control electronics 1922 and 1905, can determine when to give the firing command to release assistive energy for the desired effect. Normally the time to give the firing command is a number of milliseconds prior to golf ball impact because of inherent delay characteristics of a specific golf club design. Inherent delays in the embodiment of FIG. 19 include the following steps which take place after the firing command is given and before impact with golf ball 1917. The total time represented by these steps can be several milliseconds or more:

1. Turn-on time for a switch to apply current to coil 2002.
2. Ramping up the current in coil 2002.
3. Accelerating striker 1918.
7. Impacting golf ball 1917 with golf striker face 1919.

Figure 22:
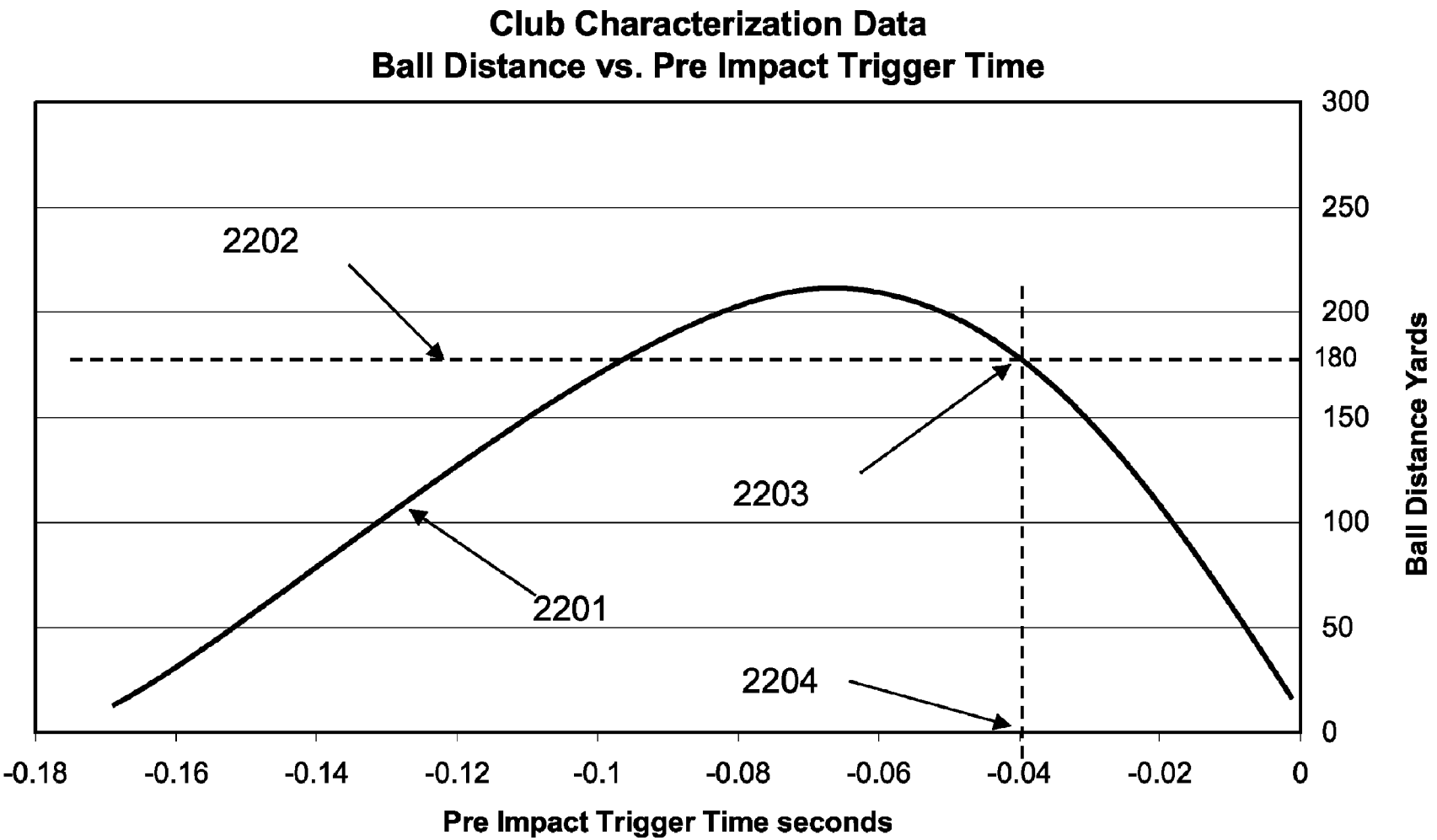
FIG. 22 is a graph of curve 2201 showing the relationship between pre impact trigger time and resulting golf ball shot distance for the embodiment of FIG. 19. Curve 2201 is characteristic of a specific approach velocity.

By testing a golf club design for resulting golf ball distance vs. pre impact triggering time, a characterization curve is created and the information is stored in control circuit 1922 to be used for the determination of when to give the firing command during a golf swing. FIG. 22 is a graph of such a characterization curve 2201 of the present invention. FIG. 22 shows how the resulting golf ball shot distance varies as a function of when the firing command is given prior to golf ball impact. Curve 2201 is determined by testing under specific weather and fairway conditions. Curve 2201 is representative of a specific approach velocity and the shape of curve 2201 will vary for different approach velocities. Families of curves for different approach velocities are determined and the data stored in control electronics 1922 for determination of when to give the firing command during a golf swing. By examination of curve 2201 in FIG. 22 the desired distance 2202 of 180 yards, intersects curve 2201 initially at point 2203 which relates to a pretrigger time 2204 of about −0.04 seconds. This means that the desired golf shot distance of 180 yards will be achieved if the firing command is given 0.04 seconds prior to impact time 2304, which occurs at point 2305 of FIG. 23.

The exact shape of characterization curves such as curve 2201 is completely dependant on many factors including the design of the golf club 1900 and the approach velocity 2303, weather and fairway topography and conditions, and can vary widely from that shown in FIG. 22.

Knowing that the characterization curve 2201 is determined under specific conditions for example a flat fairway, a golfer faced with an uphill or downhill shot will compensate by adjusting the desired golf shot distance 2202 to a longer or shorter distance.

Normally the firing command is given to add incremental velocity to a golf ball, however the firing command can also be timed to minimize or subtract incremental velocity thereby achieving golf ball velocities and distances that are less than what would be achieved by using golf club 1900 without releasing any assistive energy. The purpose of subtracting incremental velocity would be for safety reasons to limit golf shot distance, or for training or demonstration purposes or others.

When the firing command is given by control electronics 1922, coil 2002 is activated by electrical current from capacitors 1911 and 1912 traveling through flexure wires 2003. Current in coil 2002 interacts with magnetic field 2004 from magnet 2001 causing a force 2005 on striker 1918 which accelerates it forward to strike golf ball 1917 with striker face 1919. As a practical matter, magnetic field 2004 could be created by any magnetic field generating apparatus such as a field generating coil (not shown) instead of by a magnet 2001, however by using a permanent magnet 2001 made from neodymium iron cobalt, or samarium cobalt, size and weight advantages are achieved.

After impact with golf ball 1917, return springs 1920 and 1921 pull striker 1918 back into its original position to be ready for the next golf shot. Return springs 1920 and 1921 are reel type linear springs similar to a common tape measure and provide the force required to pull striker 1918 back into its original position. Capacitors 1911 and 1912 are not recharged with electrical energy until the golfer activates the golf club for the next shot by pressing switch 1907 on grip 1903. Capacitors 1911 and 1912 remain in an uncharged condition for safety reasons so golf club 1900 cannot accidentally be fired.

Figure 24:
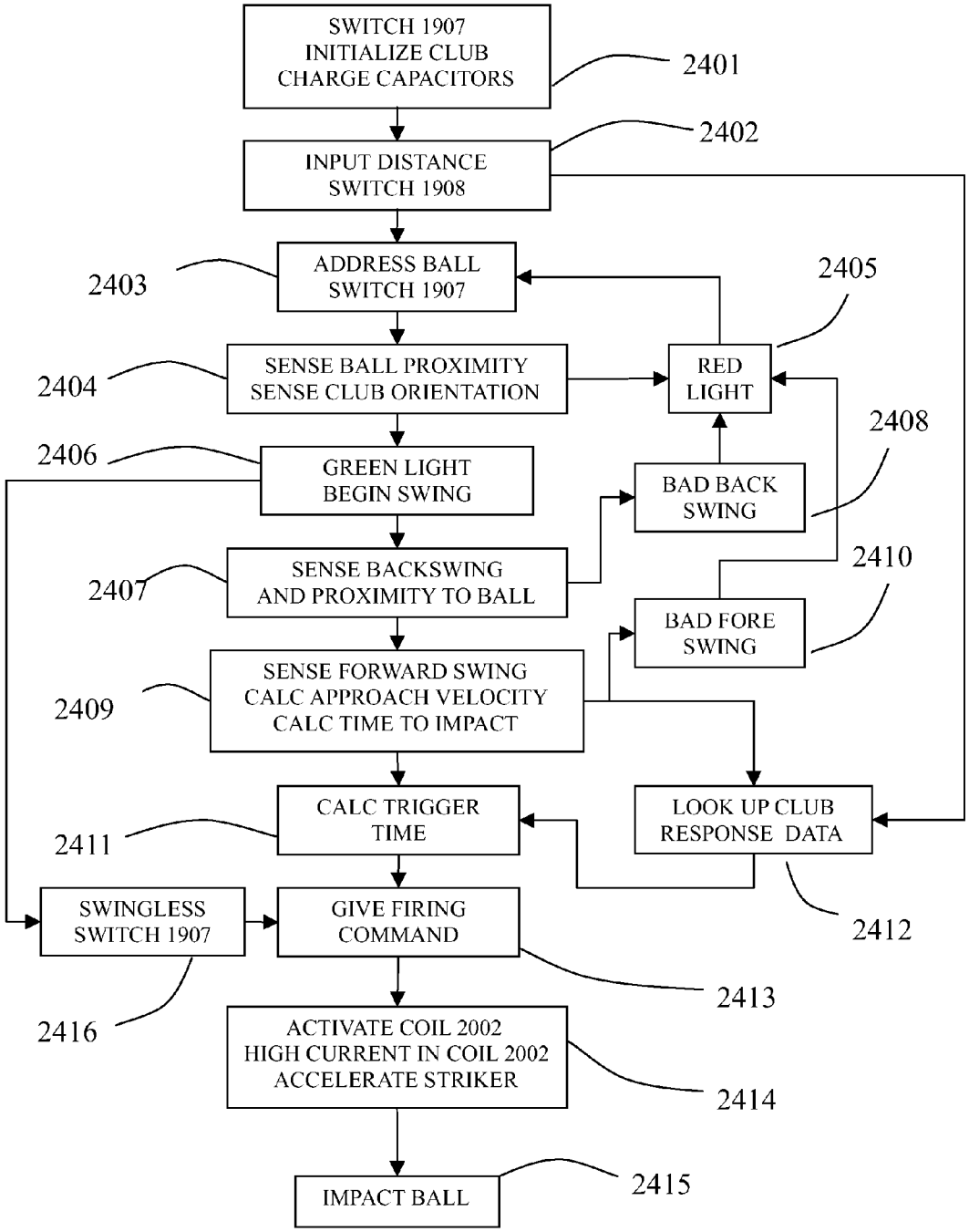
FIG. 24 is a flow chart outlining the steps during the use of the embodiment of FIG. 19.

FIG. 24 is a flow chart summarizing the sequence of steps during the use of the embodiment of FIG. 19 as follows:

FIG. 24 Reference Description:

Step 2401 The golfer first presses switch 1907 approximately 30 seconds or more prior to the golf shot. This initializes golf club 1900 and begins charging capacitors 1911 and 1912 allowing time to reach a prescribed charge. The golfer uses this time to place golf ball 1917 on tee 1916.

Step 2402 The golfer selects the desired golf shot distance for example 180 yards, using distance selection switch 1908. This inputs a desired distance value 2202 that will be used later during the calculation of the trigger time when the firing command is given. If golf club 1900 has been programmed to be used in a swinging manner, capacitors 1911 and 1912 are charged to an amount adequate for the selected golf shot distance, for example 100% of their capacity. If golf club 1900 has been programmed to be used in a swingless manner, capacitors 1911 and 1912 are charged to an amount determined by curve 2901 and the desired golf shot distance 2902, which occurs at point 2903 and indicates a capacitor charge 2904 of 75% of capacity of FIG. 29.

Step 2403 The golfer addresses the golf ball in a normal manner by placing the striker face 1919 of striker 1918 directly behind and just touching golf ball 1917, and presses switch 1907 to sense the proximity of golf ball 1917.

Step 2404 Proximity sensors 1913 and 1914 sense the strength and orientation of magnetic field 1915 to determine if golf club head 1901 is properly aligned in front of tee 1916 and therefore in front of golf ball 1917. The zero distance proximity 2302 of golf ball 1917 calculated from the strength and orientation of magnetic field 1915 is also stored for later reference as the impact point where striker face 1919 will impact golf ball 1917. Accelerometers 1923 and 1924 on control circuits 1905 and 1922 sense the orientation of golf club 1900 by sensing the direction of gravity. A commercially available accelerometer for this purpose is the Analog Devices part ADXL323.

Step 2405 If the sensed value of magnetic field 1915 or if the orientation of golf club 1900 is not correct, control circuit 1922 indicates a red light on LED 1925 and the golfer cannot proceed with a golf swing until the error is corrected. This safety feature disables golf club 1900 if it is not being used properly. For example if a golfer accidentally presses initialization switch 1907 and then strikes golf club head 1901 on his shoe to dislodge dirt, this safety feature would disable golf club 1900 and prevent accidental firing.

Step 2406 If the strength and orientation of magnetic field 1915 and the orientation of golf club 1900 are both correct, a green light is indicated on LED 1925 and the golfer knows he may proceed into a back swing in a normal manner. If golf club 1900 has been programmed to be used in a swingless manner, then the following steps 2407 through 2412 are skipped, and the golfer presses and holds switch 1907 which gives the firing command as shown in step 2416.

Step 2407 Accelerometers 1923 and 1924 and proximity sensors 1913 and 1914 sense the back swing motion and golf ball 1917 proximity as another safety feature to assure that golf club 1900 is being used in a proper manner.

Step 2408 If an improper back swing is sensed by accelerometers 1923 and 1924 or proximity sensors 1913 and 1914, a red light is indicated on LED 1925 and golf club 1900 is disabled from firing until the error is corrected.

Step 2409 If a proper back swing is sensed by accelerometers 1923 and 1924, and by proximity sensors 1913 and 1914 as shown in area 2306 of curve 2301, the forward swing is monitored by those same sensors for a proper fore swing. This is a safety feature to disable golf club 1900 for improper use. The determination of improper use can be based on safety and functionality parameters from the following list or others;

a. Improper starting orientation
b. improper swing direction
c. Swinging too fast
d. Swinging too slow
e. Swinging erratically
f. Swinging the wrong direction
g. Taking too much time
h. Hitting the ground
i. Not swinging accurately
j. Incorrect proximity to a golf ball
k. Not being proximate to a golf ball
l. Not returning club head accurately to the initial starting point During the forward swing the approach velocity of golf club head 1901 is determined from slope 2303, and the time of impact 2304 with golf ball 1917 is calculated based on the slope 2303 of curve 2301 using common linear or non-linear extrapolation or other common mathematical techniques.

Step 2410 If an improper fore swing is sensed by accelerometers 1923 and 1924 or proximity sensors 1913 and 1914, a red light is indicated on LED 1925 and golf club 1900 is disabled from firing until the error is corrected.

Steps 2411 and 2412 If a proper fore swing is sensed by accelerometers 1923 and 1924, and by proximity sensors 1913 and 1914 as shown in area 2307 of curve 2301, the trigger time 2305 is calculated based on the predicted time of impact 2304, the approach velocity 2303, and the pre triggering time 2204, which is derived from the desired golf shot distance 2202, and the response characteristic curve 2201 of FIG. 22.

Step 2413 At the determined trigger time 2305, the firing command is given. This begins the sequence of events to deliver the desired assistive energy from capacitors 1911 and 1912, to electro-mechanical velocity generating transducer 1910, to golf ball 1917.

Step 2414 The sequence of events to deliver the desired assistive energy from capacitors 1911 and 1912, to electro-mechanical velocity generating transducer 1910, to golf ball 1917 after the firing command is given can take several milliseconds or more to accomplish and includes the following steps:

1. Turing on a switch to connect capacitors 1911 and 1912 to coil 2002.
2. Ramping up current in coil 2002.
3. Accelerating striker 1918 toward golf ball 1917.
4. Impacting golf ball 1917 with striker face 1919.

Step 2415 Striker face 1919 then impacts golf ball 1917 thereby delivering the desired assistive energy to golf ball 1917 and adding the desired incremental velocity.

After the completion of the golf shot in FIG. 21, return springs 1920 and 1921 pull striker 1918 back to its original starting position as shown in FIG. 20. Capacitors 1911 and 1912 remain uncharged until golf club is 1900 is initialized just prior to the next golf shot. Capacitors 1911 and 1912 remain uncharged for safety reasons.

The use of proximity sensors and control electronics on any type of assistive energy golf club: The value of sensing the approach of a golf club head toward a golf ball and giving the firing command prior to golf ball impact has been clearly demonstrated combined with the use of electro-mechanical velocity generating transducers to deliver safe and effective assistive energy to a golf ball. While electro-magnetic velocity generating transducers are preferred due to safety and other reasons previously stated, they are not required.

Proximity sensors and electronics that give a firing command prior to golf ball impact can also be applied to other forms of power sources and velocity generating transducers such as the aforementioned explosive charge type of U.S. Pat. No. 4,170,357, or the compressed gas type of U.S. Pat. No. 6,749,528, or others. Therefore all assistive energy type golf clubs would benefit greatly from the use of proximity sensors and control electronics used in the present invention.

The invention claimed is:

1. Apparatus configured to be coupled to a golf club to impart incremental velocity to a golf ball, comprising:

a power source configured to supply power to said golf club;

a sensor that determines a proximity of said golf ball relative to a golf club head of said golf club;

a controller that is responsive to said proximity and generates a firing command prior to impact of said golf club head with said golf ball; and a velocity generating apparatus responsive to said firing command and effective to convert power from said power source into incremental velocity of said golf ball.

2. The apparatus of claim 1 where said controller generates said firing command during a swing of said golf club.

3. The apparatus of claim 2 where said generation of said firing command is based on said proximity, and on an approach velocity of said golf club head relative to said golf ball.

4. The apparatus of claim 3 where said generation of said firing command is further based on a time to impact between said golf ball and said golf club head, and on a selected golf shot distance, and on a response time characteristic of said golf club.

5. The apparatus of claim 2 further including apparatus to determine the orientation of said golf club during said swing, said controller being further responsive to a proper said orientation to generate said firing command.

6. The apparatus of claim 1 where said controller generates said firing command while said golf club is stationary and said sensor determines a proper said proximity.

7. The apparatus of claim 6 further including apparatus to determine the orientation of said golf club, said controller being further responsive to a proper said orientation to generate said firing command.

8. The apparatus of claim 1 where said velocity generating apparatus includes a least one compressible spring, said spring being operable to receive said energy from said power source, and deliver said energy to said golf ball.

9. The apparatus of claim 8 further including a motor and a force amplifier which are jointly operable to compress said spring to said receive said energy.

10. The apparatus of claim 9 further including a sear and linkage associated with said spring to retain said spring in a cocked position, and to release said spring in association with said firing command thereby converting said power into said incremental velocity of said golf ball.

11. The apparatus of claim 1 where said velocity generating apparatus includes one or more spinning flywheels, said flywheels being operable to receive said energy from said power source, and deliver said energy to said golf ball.

12. The apparatus of claim 11 further including a motor operable to spin said flywheels to a prescribed spin rate to said receive said energy.

13. The apparatus of claim 12 further including a striker associated with said flywheels operable to receive power from said flywheels and operable to accelerate and strike said golf ball thereby converting said power into said incremental velocity of said golf ball.

14. The apparatus of claim 1 where said velocity generating apparatus includes one or more magnetic field and coil pairs, said pairs being operable to receive said energy from said power source, and deliver said energy to said golf ball.

15. The apparatus of claim 14 further including a capacitor operable to store electrical charge from said power source, and further operable to deliver electrical current to said coil in association with said firing command.

16. The apparatus of claim 15 further including a striker associated with said coil operable to receive power from said pairs and operable to accelerate and strike said golf ball thereby converting said power into said incremental velocity of said golf ball.

17. The apparatus of claim 1 where said power source comprises one or more battery or capacitor type electrical charge storage elements.

18. The apparatus of claim 1 where said power source comprises a connection to an auxiliary power source located apart from said golf club.

19. Apparatus of claim 1 where said sensor that determines a proximity is a type chosen from the group consisting; laser type, ultrasonic type, radar type, accelerometer type, contact type, and magnetic type.

20. A method utilizing a golf club to impart incremental velocity to a golf ball, said method comprising;

supplying power to said golf club;

sensing the proximity of said golf ball relative to a golf club head of said golf club;

generating a firing command responsive to said proximity prior to impact of said golf club head with said golf ball; and responding to said firing command by converting power from said power source into incremental velocity of said golf ball.

21. The method of claim 20 wherein said firing command is given during a swing of said golf club.

22. The method of claim 21 further including determining a trigger time to generate said firing command during said swing to achieve a prescribed golf shot distance.

23. The method of claim 21 further including determining the orientation of said golf club during said swing, and giving said firing command based on a proper said swing.

24. The method of claim 20 wherein said converting of said power from said power source into said incremental velocity of said golf ball comprises using a magnetic field and a coil to convert electrical energy into a force to impart incremental velocity to said golf ball.

25. The method of claim 20 wherein said converting of said power from said power source into said incremental velocity of said golf ball comprises using a spring and a force amplifier to compress said spring, and to release said spring to impart incremental velocity to said golf ball.

26. The method of claim 20 wherein said converting of said power from said power source into said incremental velocity of said golf ball comprises using spinning flywheel inertia to accelerate a striker to impart incremental velocity to said golf ball.

27. The method of claim 20 further including sensing the orientation of said golf club, said generating a firing command being responsive to a determination of a proper said orientation.

28. The method of claim 20 wherein said firing command is generated when said golf club is stationary.

29. An apparatus configured to be couple to a golf club to impart incremental velocity to a golf ball, comprising:

a power source configured to supply power to said golf club;

a controller that generates a firing command prior to impact of a head of said golf club with said golf ball;

a velocity generating apparatus responsive to said firing command and effective to convert power from said power source into incremental velocity of said golf ball;

said velocity generating apparatus including at least one compressible spring, said spring being operable to receive said energy from said power source, and deliver said energy to said golf ball; and said velocity generating apparatus further including a motor and a force amplifier which are jointly operable to compress said spring to receive said energy.

30. An apparatus configured to be coupled to a golf club to impart incremental velocity to a golf ball, comprising:

a power source configured to supply power to said golf club;

a controller that generates a firing command prior to impact of a head of said golf club with said golf ball a velocity generating apparatus responsive to said firing command and effective to convert power from said power source into incremental velocity of said golf ball; and said velocity generating apparatus including one or more spinning flywheels, said flywheels being operable to receive said energy from said power source, and deliver said energy to said golf ball.

31. An apparatus configured to be coupled to a golf club to impart incremental velocity to a golf ball, comprising:

a power source configured to supply power to said golf club;

a controller that generates a firing command prior to impact of a head of said golf club with said golf ball;

a velocity generating apparatus responsive to said firing command and effective to convert power from said power source into incremental velocity of said golf ball;

said velocity generating apparatus including one or more magnetic field and coil pairs, said pairs being operable to receive said energy from said power source, and deliver said energy to said golf ball; and said velocity generating apparatus further including a striker associated with said coil operable to receive power from said pairs, said striker having a striker face operable to accelerate outwardly from a face of said golf club head and strike said golf ball thereby converting said power into said incremental velocity of said golf ball.

* * * * *